US006012404A

United States Patent [19]

Ogawa et al.

[11] Patent Number: 6,012,404

[45] Date of Patent: Jan. 11, 2000

[54] ZIGZAG PATTERN CHANGING DEVICE FOR A SEWING MACHINE

[75] Inventors: Tatsuya Ogawa; Takashi Nishikawa; Atsushi Kudo; Sadao Oshima, all of Tokyo, Japan

[73] Assignee: Juki Corporation, Tokyo, Japan

[21] Appl. No.: 09/150,470

[22] Filed: Sep. 9, 1998

[30] Foreign Application Priority Data

| | | | |
|---|---|---|---|
| Sep. 11, 1997 | [JP] | Japan | 9-246604 |
| Jul. 8, 1998 | [JP] | Japan | 10-002277 |
| Sep. 3, 1998 | [JP] | Japan | 10-250094 |

[51] Int. Cl.[7] ..... D05B 3/02

[52] U.S. Cl. ..... 112/466

[58] Field of Search ..... 112/466, 465, 112/448, 449, 459, 460, 461, 462, 463, 464

[56] References Cited

U.S. PATENT DOCUMENTS

| | | | |
|---|---|---|---|
| 3,062,164 | 11/1962 | Shimada | 112/460 |
| 3,188,991 | 6/1965 | Ohira | 112/444 |
| 5,727,486 | 3/1998 | Satoh | 112/459 |

*Primary Examiner*—Peter Nerbun
*Attorney, Agent, or Firm*—Morgan & Finnegan LLP

[57] ABSTRACT

A sewing machine zigzag pattern changing device comprises: a cam drive shaft (11) supported in a sewing machine frame in such a manner that it can be rotated deceleratingly in linking with a sewing machine main shaft; a needle swing cam (13) supported on the cam drive shaft and including at least two cams which are spaced apart from each other in the axial direction of the needle swing cam and respectively correspond to different needle swing patterns; a needle swing drive shaft (20) disposed in parallel to the cam drive shaft, supported in the sewing machine frame in such a manner that it is capable of swing motion about the axis thereof, and connected to a needle mechanism so that it can move a needle in a direction at right angles to a cloth feeding direction due to the above swing motion; a cam body (50) including a pair of contact bodies separately engageable with and removable from the two cams, capable of transmitting the swing motion of the contact body due to one of the needle swing cams to be engaged to the needle swing drive shaft, and supported on the needle swing drive shaft in such a manner that it can be moved in the axial direction of the needle swing drive shaft; switch means (59) connected to the cam body for moving the cam body in the axial direction of the needle swing drive shaft to one position where one contact member can be engaged with one cam groove as well as to another position where the other contact member can be engaged with the other cam groove; a guide member disposed in parallel to the axial direction of the needle swing drive shaft; and, a member to be guided engageable with the guide member and relatively movable in the axial direction of the needle swing drive shaft.

18 Claims, 22 Drawing Sheets

ZIGZAG PATTERN CHANGING DEVICE FOR A SEWING MACHINE

BACKGROUND OF THE INVENTION

The present invention relates to a zigzag pattern changing device for use in a sewing machine and, in particular, to such sewing machine zigzag pattern changing device which is suitable for forming different needle swing patterns easily.

Conventionally, in a sewing machine which is capable of forming a needle swing pattern such as a zigzag or other similar patterns, there is disposed a needle swing device which, in a sewing operation, moves a vertically moving needle in a horizontal direction intersecting at right angles to a cloth feeding direction to thereby be able to control a needle drop position.

The conventional needle swing device includes a needle swing cam connected to the main shaft of the sewing machine in such a manner that it is rotated once each time the sewing machine main shaft is rotated a given number of times; and, in the needle swing cam, there is formed a cam groove which controls the needle drop position each time the sewing machine main shaft is rotated once to form a given needle swing pattern. In particular, a needle bar is swung right and left along the cam shape of the cam groove to thereby control the needle drop position.

Now, in FIGS. 29 and 30, there is shown the conventional needle swing device. In FIG. 29, a pulley 10 is fixed to the rear end of an upper shaft (main shaft) 2 supported rotatably on the machine frame of a sewing machine main body 1, and the pulley 10 is connected to a sewing machine motor (not shown) through a belt (not shown) wound around the pulley 10. In the interior portion of the machine frame of the sewing machine main body 1, a well-known needle bar drive mechanism (not shown) comprising a crank and the like is provided between the upper shaft 2 and a needle bar 3 in such a manner that the needle bar 3 can be moved up and down once each time the upper shaft 2 is rotated once. The needle bar 3 is supported in a vertically movable manner by a needle swing arm 4 which is formed in a substantially U-like shape.

A cam drive shaft 11 which has a horizontally extending axis crossing at right angles to the axial direction of the upper shaft 2 is rotatably supported by a frame of the sewing machine body 1; and, on the rear end side of the cam drive shaft 11 protruding into a space portion 1A formed on the rear side of the sewing machine body 1 (on right hand of FIG. 30), there is fixed a needle swing cam 13 including a sewing machine main body front side surface thereof (on left side of FIG. 30) a cam groove 12 which is formed on the circumference thereof and is shiftable in position in the diameter direction thereof to control the needle swing motion, while a cover 14 is removably mounted on the sewing machine main body 1 in such a manner that it covers the space portion 1A. Also, on the front end side of the cam drive shaft 11, there is fixed a cam drive gear 15. In operation, the cam drive shaft 11 can be driven or rotated deceleratingly through a worm wheel 17 rotatable in linking with a lower shaft (not shown) connected to the upper shaft 2 as mentioned above, a transmission gear 16 fixed on the same shaft as the worm wheel 17, and the cam drive gear 15 meshingly engageable with the transmission gear 16.

As shown in FIG. 30, a needle swing drive shaft 20, which is arranged in parallel to the cam drive shaft 11, is rotatably supported on the sewing machine main body machine frame. And, to the rear end side of the needle swing drive shaft 20 which protrudes into the space portion 1A, there is fixed the base end of a cam arm which supports on the leading end thereof a cam roller 19 engageable with the cam groove 12, while the base end portion of a needle swing drive arm 21 is fixed to the middle portion of the needle swing drive shaft 20. Also, as shown in FIG. 29, the lower end portion of a drive rod 22 is rotatably supported on the leading end portion of the needle swing drive arm 21 by a pin 23.

In FIG. 29, a needle swing shaft 5, which supports the needle swing arm 4 on one end thereof in a fixed manner, is supported movably in the axial direction (in FIG. 29, in the right and left direction) thereof by a bearing portion 6 which is formed in the machine frame of the sewing machine main body 1. Also, to the other end of the needle swing shaft 5, there is connected one end (in FIG. 29, the left end) of a needle swing drive link 7 through a joint 8 such that it is rotatable around a horizontal axis. And, the other end (in FIG. 29, the right end) of the needle swing drive link 7 is rotatably connected to the leading end of a swing width change link 9, while the upper end of the drive rod 22 is connected to the middle portion of the needle swing drive link 7.

The base end of the swing width change link 9, by operating an operation lever (not shown) from outside the machine frame of the sewing machine main body 1, can be shifted or moved in the vertical direction and can be secured to the vertically shifted position; that is, the needle swing width can be changed by means of such secured position.

In the above-structured conventional sewing machine needle swing device, if the lower shaft is rotated in linking with the rotational driving of the upper shaft 2, then the worm wheel 17 is rotationally driven in linking with the lower shaft, the rotational force of the worm wheel 17 is transmitted through the transmission gear 16 to the cam drive gear 15 to thereby rotate the cam drive shaft 11, so that the needle swing cam 13 is rotated. And, the cam groove 12 is then radially displaced due to the rotation of the needle swing cam 13 and the cam roller 19 follows the rotational motion of the cam groove 12, thereby causing the cam arm 18 to swing. The swinging motion of the cam arm 18 then swings the needle swing drive arm 21 formed integrally with the needle swing drive shaft 20, so that the drive rod 22 can be reciprocated in the vertical direction.

When the vertical motion of the drive rod 22 is transmitted to the needle swing drive link 7, then the needle swing drive link 7 is swung, while the swinging motion thereof is restricted by the swinging motion of the swing width change link 9 about the base end (in FIG. 29, the left end) thereof. Therefore, the needle swing drive link 7 is swung in the horizontal direction due to the horizontal-direction component of the swinging motion of the swing width change link 9. As a result of this, the needle swing shaft 5 is swung in the axial direction thereof through the joint 8 and thus the needle swing arm 4 is swung in the horizontal direction to thereby to cause the needle bar 3 supported thereon to carry out its needle swing operation, so that a needle swing pattern can be, formed.

By the way, in the conventional sewing machine needle swing device, when forming, as a needle swing pattern, different needle swing patterns, for example, a two-dot zigzag shown in FIG. 31 and a four-dot zigzag shown in FIG. 32, such pattern formation is executed by replacing the needle swing cam 13.

Therefore, when changing the needle swing pattern, after the cam cover 14 is removed to thereby remove nuts or the like, the needle swing cam 13 is removed and replaced with a new needle swing cam 13 in which a cam groove 12 having a desired shape is formed. This replacement operation requires much labor, time and skill in dismantling and assembling associated parts.

In view of this, for example, as disclosed in Unexamined Japanese Patent Application Publication No. Hei. 8-117463, there is conventionally proposed a sewing machine needle swing pattern changing device which is able to form different needle swing patterns easily without replacing the needle swing cam 13 with a new one.

Here, in FIG. 33, there is shown an embodiment of a sewing machine needle swing pattern changing device which is disclosed in Unexamined Japanese Patent Application Publication No. Hei. 8-117463. In this device, on the inner wall of a sewing machine main body 1, there is journaled a cam drive shaft 11 which extends in the longitudinal direction of the sewing machine main body 1 and can be rotationally driven by means of the rotation of a lower shaft (not shown) through a drive transmission mechanism; and, on the rear end portion of the cam drive shaft 11, there is mounted by a screw 24 a needle swing cam 13 which includes cam grooves 12*a* and 12*b* formed on the two surface sides thereof and having their respective desired shapes. The two cam grooves 12*a* and 12*b* are respectively so formed as to have their own desired needle patterns which are frequently selected: for example, one cam groove 12*a* is so formed to have a cam shape capable of forming such a two-point zigzag as shown in FIG. 31, whereas the other cam groove 12*b* is so formed to have a cam shape capable of forming such a four-point zigzag as shown in FIG. 32; that is, the two cam grooves are respectively have two kinds of cam shapes which allow the formation of the needle swing patterns that are used relatively frequently.

A needle swing drive shaft 20 is rotatably journaled in parallel to the cam drive shaft 11, while a cam body 25 is loosely fitted with one end portion of the needle swing drive shaft 20. On the outer periphery of the needle swing drive shaft 20, there is formed a key groove 26 which extends in the axial direction thereof. A key 27, which is referred to as a sliding key, is mounted in the key groove 26. In the inner periphery of the cam body 25, there is formed a key groove 28 which can be slidably fitted with the key 27. And, due to the rotational motion of the cam body 25, the needle swing drive shaft 20 can be rotated integrally with the cam body 25.

Also, in the two end portions of the cam body 25, there are two cam arms 18*a* and 18*b* which are formed integrally with their respective cam body end portions and also which are projected on the two sides of the cam body 25 with the needle swing cam 13 between them. In the respective leading end portions of the two cam arms 18*a* and 18*b*, there are mounted support shafts 30 which project in the mutually opposing directions. Also, on the respective support shafts 30, there are mounted cam rollers 19*a* and 19*b* which can be respectively engaged with the cam grooves 12*a* and 12*b*. These cam rollers 19*a* and 19*b* are structured such that, when one cam roller 19*a* is in engagement with the cam groove 12*a* on one surface side, the other cam roller 19*b* is prevented from being engaged with the cam groove 12*b* on the other surface side.

Also, on one end face of the cam body 25, there is provided a screw shaft 31 having a male screw formed on the outer periphery thereof; and, the screw shaft 31 is formed integrally with the cam body 25 end face and is also structured such that it is coaxial with the needle swing drive shaft 20. Further, the screw shaft 31 is rotatably supported by a support plate 32 which is mounted on the inner wall of the sewing machine main body 1. With the outer peripheral side of the screw shaft 31, there is threadedly engaged a rotary bush 34 serving as a moving mechanism 33 which extends through the support plate 32 from the inside thereof and also which, when changing the needle swing pattern, moves the cam body 25 in the axial direction thereof; and, to the portion of the rotary bush 34 located on the outside portion of the support plate 32, there is fixed a switching dial 35. This switching dial 35 prevents the rotary bush 34 from moving in the axial direction with respect to the support plate 32. Also, with the leading end portion of the screw shaft 31, there is threadedly engaged a lock nut 36. Further, on the support plate 32, there is mounted a cam cover 14 which is used to cover the needle swing cam 13. The remaining portions of the present device are similar in structure to the previously described conventional sewing machine needle swing device and thus the description thereof is omitted here.

In the thus structured sewing machine needle swing device, when changing the needle swing operation, with the lock nut 36 loosened, the switching dial 35 is rotationally operated to thereby rotate the rotary bush 34 serving as the moving mechanism 33. In this case since the rotary bush 34 is supported by the support plate 32 and is thus prevented from moving in the axial direction, only the screw shaft 31 is moved in the axial direction, so that the cam body 25 is moved along the needle swing drive shaft 20. And, the engagement of the cam roller 19*a*, which has been engaged with one cam groove 12*b* of the needle swing cam 13, is removed, whereas the other cam roller 19*a* is brought into engagement with the cam groove 12*b*.

After then, if the needle swing cam 13 is driven or rotated, then the needle bar can be driven by the cam shape of the cam groove 12*b*, that is, by a different needle swing operation from that of the cam groove 12*a*, thereby being able to form a different needle swing pattern.

In other words, the rotational operation of the switching dial 35 allows easy switching of the needle swing patterns.

By the way, as the conventional sewing machine zigzag pattern changing device, there is also proposed a device which, instead of the needle swing cam 13 with the cam grooves 12*a* and 12*b* formed therein, employs a needle swing cam comprising a conjugate cam (not shown) which includes different cam surfaces on the outer peripheral surfaces thereof.

However, in the conventional sewing machine zigzag pattern changing device disclosed in the above patent publication and shown in FIG. 33, there are raised various problems which result from the needle swing pattern changing structure thereof.

For example, when changing the needle swing pattern, the key groove 28 formed in the inner periphery of the cam body 25 is slid along the axially-extending key 27 mounted in the key groove 26 formed in the outer periphery of the needle swing drive shaft 20. In this structure, however, the cam body 25 cannot be moved smoothly in the axial direction of the needle swing drive shaft 20 due to the sliding resistance thereof.

Also, because the working and assembling precision of these key grooves 26, 28 and key 27 requires a high degree of technical skill, the manufacturing costs thereof are expensive. At the same time, when an error or the like is produced while they are being worked and assembled together, the cam body 25 and needle swing drive shaft 20 are made loose with respect to each other in the rotation direction of the needle swing drive shaft 20, and this loose condition or play is amplified before it is transmitted to the needle bar 3, that is, the needle bar 3 is made loose on both right and left side thereof (a so-called needle bar right and left play), so that a given needle swing position cannot be set, which results in the lowered sewing quality.

Further, the occurrence of such loose condition between the cam body 25 and needle swing drive shaft 20 applies an excessive overload, in more particular, a shearing load due to a shock to the key 27 each time the needle swing cam 13 is driven or rotated and the swinging motion of the cam arm 18 of the cam body 25 is thereby transmitted to the needle swing drive shaft 20, that is, each time a sewing operation is executed, so that the key 27 can be broken.

Also, in the mechanism shown in FIG. 33, when the cam body 25 is moved along the needle swing drive shaft 20 in order to change the needle swing pattern, for example, one cam roller 19*a* in engagement with one cam groove 12*a* of the needle swing cam 13 is separated from the cam groove 12*a*, that is, the engagement between them is removed and, at the same time, the other cam roller 19*b* situated at a non-engaging position is made to advance into the other cam groove 12*b* of the needle swing cam 13 so that it is thereby engaged with the other cam groove 12*b*. The engagement or removal of the cam rollers 19*a* and 19*b* with or from the cam grooves 12*a* and 12*b* must be carried out at the same time and, therefore, the two cam rollers 19*a* and 19*b* are set at positions respectively opposed to the cam grooves 12*a* and 12*b*, that is, at a switch point SP which is shown in FIG. 34. For this reason, when changing the needle swing pattern, the needle swing cam 13 must be stopped in a phase which provides the switching point SP. However, since such phase is difficult to find out, there is necessary a vast amount of labor or a highly skilled technique, which leads to the lowered operation efficiency.

Also, the occurrence of such loose condition between the cam body 25 and needle swing drive shaft 20 changes the positions of the respective cam rollers 19*a* and 19*b*, thereby causing the switch point SP of the needle swing cam 13 to vary when changing the needle swing pattern, which increases the labor and time necessary for the switching operation further.

Further, when changing the needle swing pattern, as shown in FIG. 35, the cam rollers 19*a* and 19*b* can be both engaged with the cam grooves 12*a* and 12*b* in the middle of the needle swing pattern changing operation. Therefore, when the movement of the cam body 25 along the needle swing drive shaft 20 is insufficient due to a mistake made by an operator, there is a possibility that the sewing machine can be driven with the cam rollers 19*a* and 19*b* respectively in engagement with the cam grooves 12*a* and 12*b* to thereby cause the zigzag pattern changing device to be broken.

In addition, there are found similar problems even in the zigzag pattern changing device which employs a needle swing cam comprising a conjugate cam.

In view of the circumstances of the conventional zigzag pattern changing devices, there is the need for development of a sewing machine zigzag pattern changing device which is able to change the needle swing pattern easily and properly.

The present invention aims at eliminating the drawbacks found in the conventional sewing machine zigzag pattern changing devices. Accordingly, it is an object of the invention to provide a sewing machine zigzag pattern changing device which is able to change different needle swing patterns over to each other easily and properly, without replacing a needle swing cam.

SUMMARY OF THE INVENTION

In attaining the above object, according to a first aspect of the invention, there is provided a zigzag pattern changing device for use in a sewing machine, which comprises: a cam drive shaft (11) supported in a sewing machine frame in such a manner that it can be rotated deceleratingly in linking with a sewing machine main shaft; a needle swing cam (13) supported on the cam drive shaft and including at least two cams which are spaced apart from each other in the axial direction of the needle swing cam and respectively correspond to different needle swing patterns; a needle swing drive shaft (20) disposed in parallel to the cam drive shaft, supported in the sewing machine frame in such a manner that it is capable of swing motion about the axis thereof, and connected to a needle mechanism so that it can move a needle in a direction at right angles to a cloth feeding direction due to the above swing motion; a cam body (50) including a pair of contact bodies separately engageable with and removable from the two cams, capable of transmitting the swing motion of the contact body due to one of the needle swing cams to be engaged to the needle swing drive shaft, and supported on the needle swing drive shaft in such a manner that it can be moved in the axial direction of the needle swing drive shaft; switching means (59) connected to the cam body for moving the cam body in the axial direction of the needle swing drive shaft to one position where one contact member can be engaged with one cam groove and to the other position where the other contact member can be engaged with the other cam groove; a guiding member disposed in parallel to the axial direction of the needle swing drive shaft; and, a guided member to be guided engageable with the guide member and relatively movable in the axial direction of the needle swing drive shaft.

According to a second aspect of the invention, there is provided a zigzag pattern changing device for use in a sewing machine, in which the guiding member and the guided member are respectively comprising a guide shaft, which is supported on one of the needle swing drive shaft and cam body, and a guide hole which is formed in the other of the needle swing drive shaft and cam body and into which the guide shaft can be slidably fitted.

According to a third aspect of the invention, there is provided a zigzag pattern changing device for use in a sewing machine, in which the guiding member comprises a plane portion which is formed in the outer periphery of the needle swing drive shaft and extends in the axial direction of the needle swing drive shaft, and the guided member comprises a stopper including a flat surface portion which can be slidably contacted with the above plane portion.

According to a fourth aspect of the invention, there is provided a zigzag pattern changing device for use in a sewing machine, which further includes a needle swing drive arm supported on the needle swing drive shaft for transmitting the swing motion of the needle swing drive shaft to a needle mechanism, in which the guide member and the guided member respectively comprise a guide shaft supported on one of the needle swing drive shaft and cam body, and a guide hole which is formed in the other of the needle swing drive shaft and cam body and into which the guide shaft can be slidably fitted.

According to a fifth aspect of the invention, there is provided a zigzag pattern changing device for use in a sewing machine, which comprises: a cam drive shaft (11) supported in a sewing machine frame in such a manner that it can be rotated deceleratingly in linking with a sewing machine main shaft; a needle swing cam (13) supported on the cam drive shaft and including two cam grooves which are respectively formed on the two surfaces thereof extending in the axial direction thereof and respectively correspond to different needle swing patterns; a needle swing drive shaft (20) disposed in parallel to the cam drive shaft, supported in the sewing machine frame in such a manner that it is capable of swing motion about the axis thereof, and connected to a needle mechanism so that it can move a needle in a direction at right angles to a cloth feeding direction due to the above swing motion; a cam body (50) including a pair of contact bodies separately engageable with and removable from the two cam grooves, capable of transmitting the swing motion of the contact body due to one of the cam grooves to be engaged to the needle swing cam, and supported on the needle swing drive shaft in such a manner that it can be moved in the axial direction of the needle swing drive shaft; switching means (59) connected to the cam body for moving the cam body in the axial direction of the needle swing drive shaft to one position where one contact member can be engaged with one cam groove and to the other position where the other contact member can be engaged with the other cam groove; and, a support member extending along the direction of an axis in parallel to the needle swing drive shaft, spaced in a diameter direction from the axis, and supporting the cam body in such a manner that the cam body can be slid in the axial direction of the needle swing drive shaft, thereby preventing the cam body from rotating around the axis of the needle swing drive shaft.

According to a sixth aspect of the invention, there is provided a zigzag pattern changing device for use in a sewing machine, in which, at a position in the middle of the movement of the cam body to the two positions by the switching means, there can be set a non-engagement state in which both of the contact bodies are separated from their respective cam grooves.

According to a seventh aspect of the invention, there is provided a zigzag pattern changing device for use in a sewing machine, in which a pair of marks are provided in correspondence to the rotation phase of the needle swing cam in which the contact bodies are both situated opposed to the cam grooves.

According to an eighth aspect of the invention, there is provided a zigzag pattern changing device for use in a sewing machine, in which the pair of marks are respectively formed in the needle swing cam and in the sewing machine frame.

According to a ninth aspect of the invention, there is provided a zigzag pattern changing device for use in a sewing machine, in which the pair of marks are respectively formed in a sewing machine drive shaft and in the sewing machine frame.

According to a tenth aspect of the invention, there is provided a zigzag pattern changing device for use in a sewing machine, which further includes an operation part that makes it possible to operate the cam body from outside the sewing machine and thereby move the same in the axial direction of the needle swing drive shaft.

According to an eleventh aspect of the invention, there is provided a zigzag pattern changing device for use in a sewing machine, in which the operation part is disposed in the stud portion of the sewing machine main body.

According to a twelfth aspect of the invention, there is provided a zigzag pattern changing device for use in a sewing machine, in which the operation part includes a positioning pin movable in linking with the operation of a change lever and a pair of recessed portions fittable with the positioning pin, the positioning pin is normally energized in a direction where it can be fitted with the recessed portions, and a transition portion between the pair of recessed portions is formed in a shape which comprises a pair of inclined surfaces each having one end thereof connected to the corresponding recessed portion and also which has a triangular cross section.

According to a thirteenth aspect of the invention, there is provided a zigzag pattern changing device for use in a sewing machine, in which, in the respective bottom portions of the pair of recessed portions, there are disposed switches for detecting the presence or absence of the positioning pin.

According to a fourteenth aspect of the invention, there is provided a zigzag pattern changing device for use in a sewing machine, in which, upwardly of positions where the pair of cam grooves are formed, there are disposed oil drop supply means which are respectively structured such that they are capable of dropping oil, which has previously been suck up by an oil supply pump, down to the contact bodies fittable with the respective cam grooves.

DETAILED DESCRIPTION OF THE EMBODIMENTS

Now, description will be given below of the embodiments of a sewing machine zigzag pattern changing device according to the invention with reference to the accompanying drawings.

In the following description, parts which are the same or equivalent to those employed in the above-mentioned conventional sewing machine zigzag pattern changing devices are given the same designations and thus the detailed description thereof is omitted here.

Figure 1:
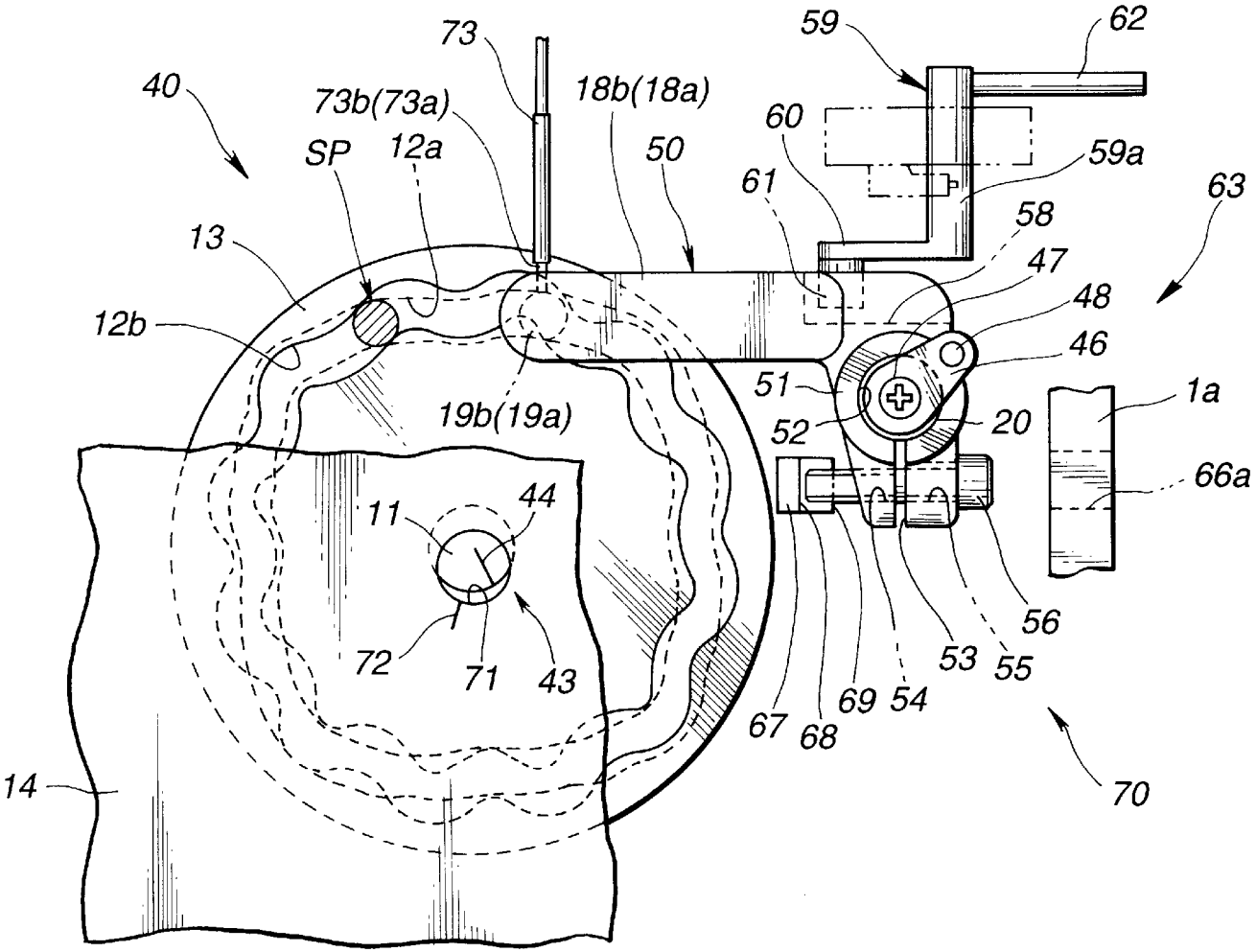
FIG. 1 is a partially omitted front section view of the main portions of a first embodiment of a sewing machine zigzag pattern changing device according to the invention, showing a sewable state thereof in which one cam roller is in engagement with one cam groove to thereby be able to form one needle swing pattern.
Figure 2:
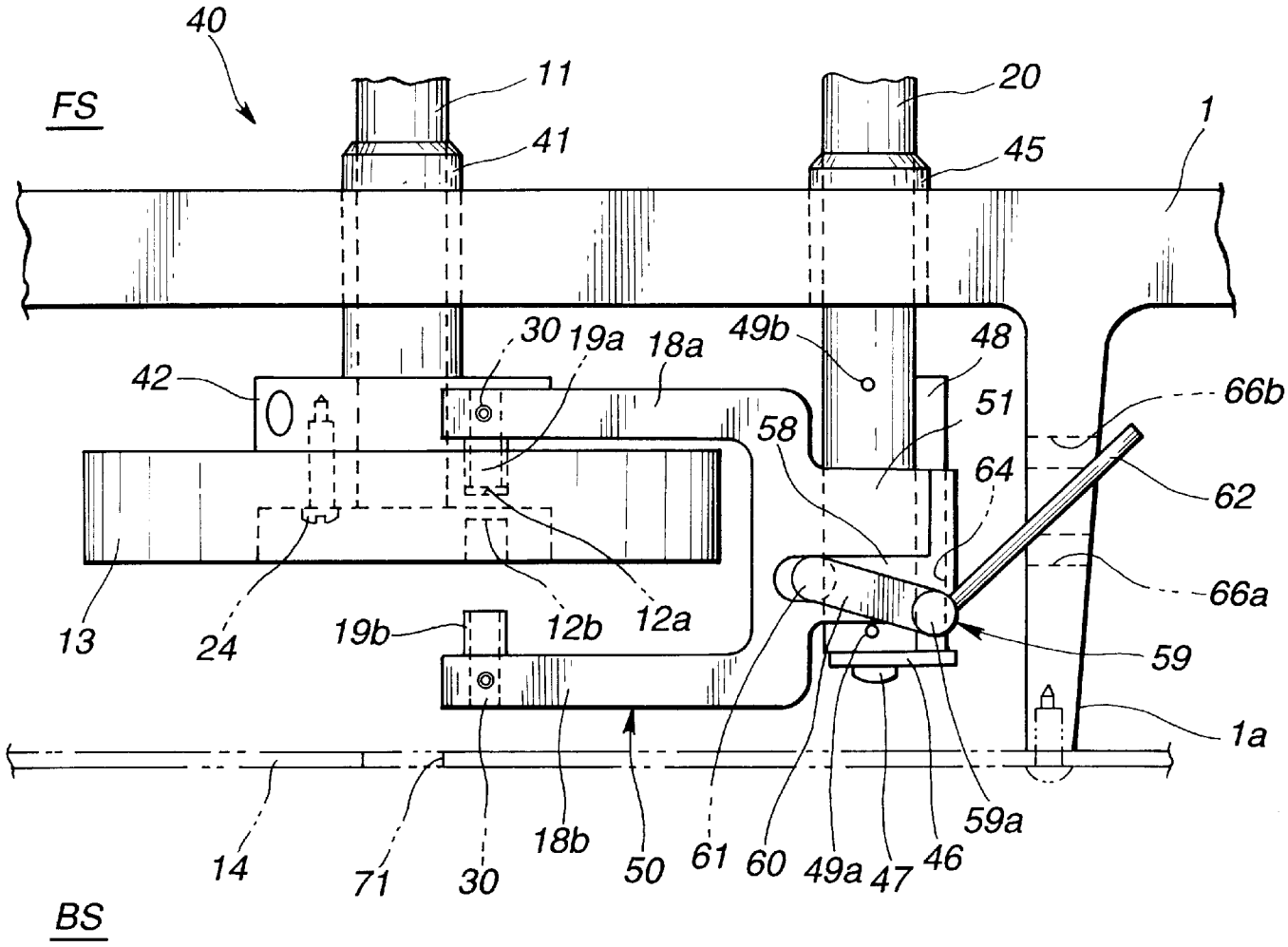
FIG. 2 is a partially omitted plan view of FIG. 1.
Figure 30:
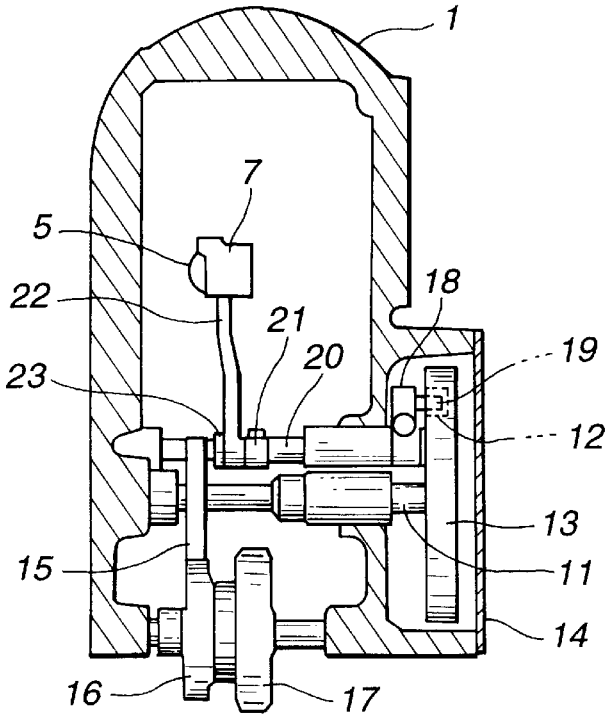
FIG. 30 is a side section view of FIG. 29.

In FIGS. 1 and 2, there is shown a sewing machine zigzag pattern changing device 40 according to a first embodiment of the present invention. In the present sewing machine zigzag pattern changing device 40, a cam drive shaft 11, which extends horizontally in the longitudinal direction (in FIG. 2, in the vertical direction) of a sewing machine main body 1, is rotatably supported through a bearing 41 on the machine frame of the sewing machine main body 1; and, similar to the conventional one as shown in FIG. 30, the present cam drive shaft 11 can be deceleratingly rotated due to the rotation of a lower shaft 37 through a drive force transmission mechanism which comprises the above-mentioned worm wheel 17, transmission gear 16, a cam drive gear 15 and the like.

And, a cam receiver 42 is fixed to the rear end portion of the cam drive shaft 11 that is projected into a space portion 1A existing in the outside (in FIG. 1, BS) of the rear machine frame of the sewing machine main body 1; and, a needle swing cam 13, which includes cam grooves 12*a* and 12*b* respectively formed in the front and rear surfaces thereof and having different shapes, is fixed to the cam receiver 42 from the outside BS by a plurality of screws 24. If a cover 14 covering the space portion is removed, then these screws 24 can be operated from the sewing machine outside BS. Also, by mounting and removing the screws 24 from the sewing machine outside BS, the needle swing cam 13 can be replaced. In the rear end face of the cam drive shaft 11, there is provided a mark 44 (FIG. 1) forming switching display means 43 which will be discussed later.

Figure 31:
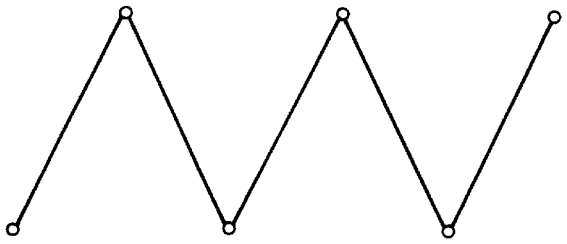
PRIOR ART FIG.31
FIG. 31 is a typical view of a two-point zigzag.
Figure 32:
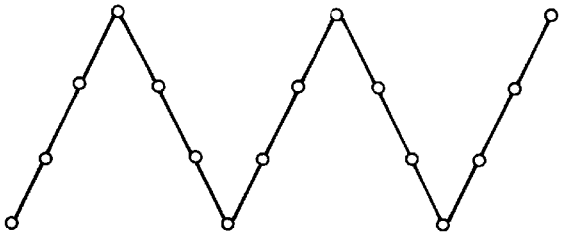
FIG. 32 is a typical view of a four-point zigzag.
Figure 33:
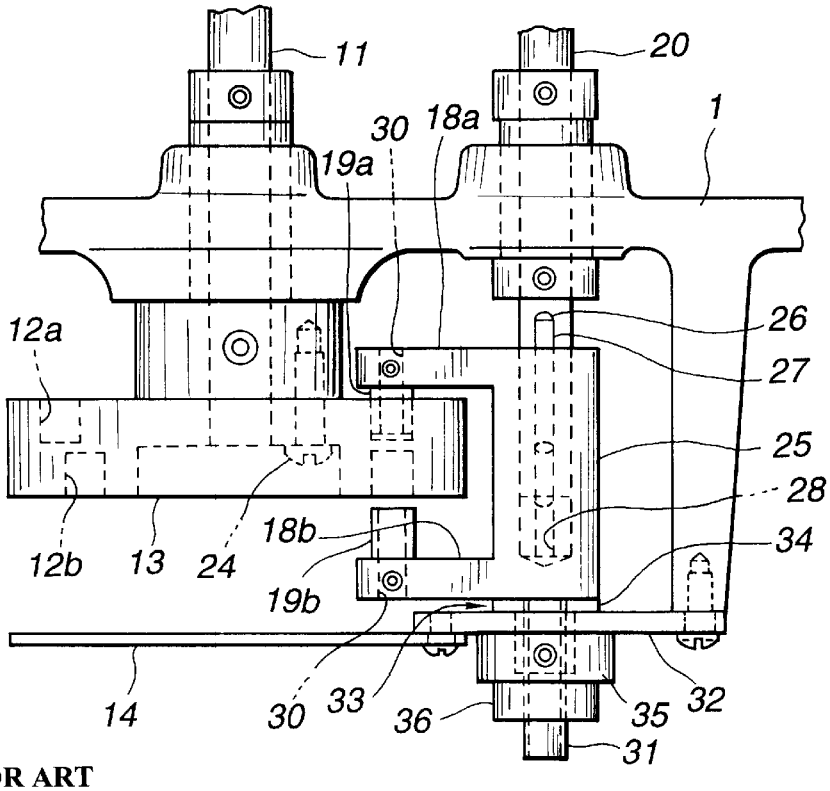
FIG. 33 is a plan view of the main portions of a conventional sewing machine zigzag pattern changing device which is able to form different needle swing patterns easily.
Figure 34:
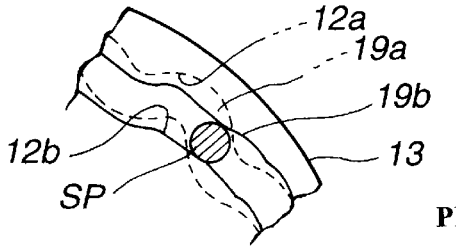
PRIOR ART FIG.34
FIG. 34 is an explanatory view of the switch point of a needle swing cam when changing the needle swing pattern in the conventional sewing machine zigzag pattern changing device in FIG. 33; and, FIG. 35 is an explanatory view of a case in which the movement of a cam body shown in FIG. 33 is not sufficient.
Figure 35:
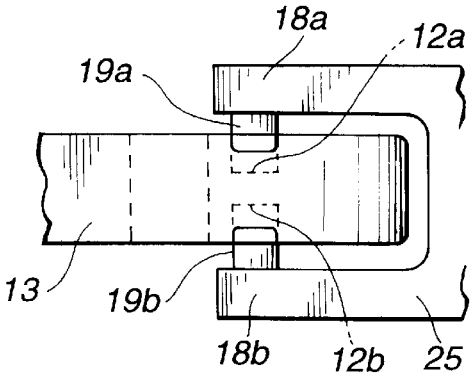
PRIOR ART FIG.35

In the present embodiment, the two cam grooves 12*a* and 12*b* of the needle swing cam 13 are formed as cam grooves which can be shifted in position in the diameter direction of the needle swing cam 13 in correspondence to highly frequently used needle swing patterns, for example, one of the cam grooves can be shifted in correspondence to the two-dot zigzag (FIG. 31), whereas the other can be shifted in correspondence to the four-dot zigzag (FIG. 32). However, this is not limitative but, the two cam grooves 12*a* and 12*b* of the needle swing cam 13 may also be formed as cam grooves which can be shifted in position in correspondence to other needle swing patterns.

Figure 3:
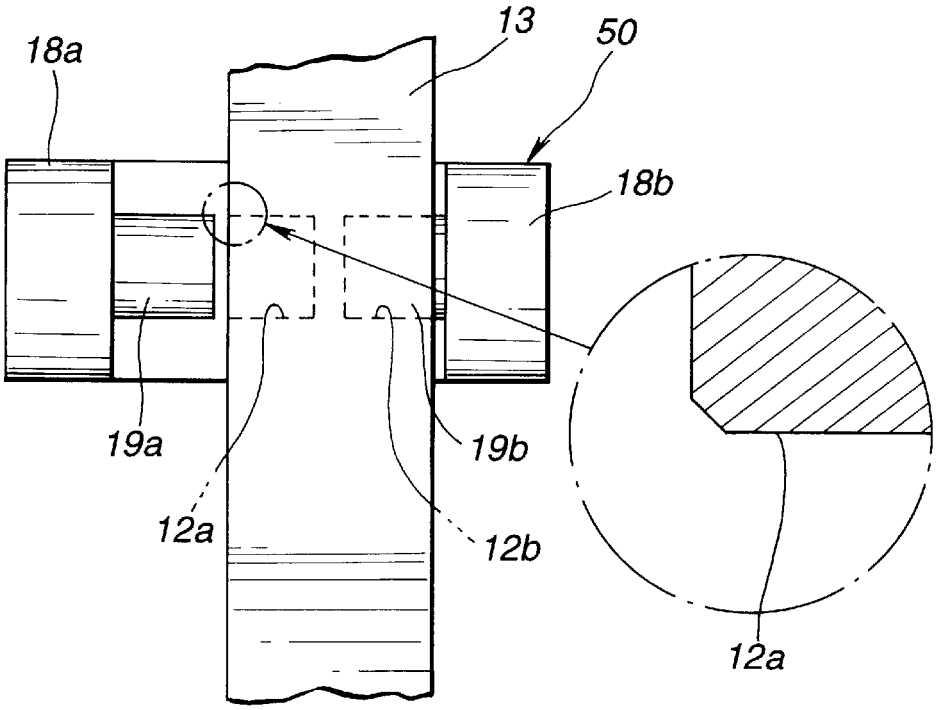
FIG. 3 is an enlarged explanatory view of the shape of the cam groove shown in FIG. 1.

Also, the above-mentioned two cam grooves 12*a* and 12*b* may also be formed in such a manner that, as shown in FIG. 3, the edge portions thereof are chamfered to thereby prevent the leading end portions of cam rollers 19*a* and 19*b* from getting caught by the edge portions of the cam grooves 12*a* and 12*b*. This can make it easy for the cam rollers 19*a* and 19*b* to be engaged with the cam grooves 12*a* and 12*b*. By the way, it is not necessary that the chamfered treatment is enforced over the whole peripheries of the cam grooves 12*a* and 12*b*, but, if at least the switch point SP portion is chamfered, then the expected object can be attained.

On the rear machine frame of the sewing machine main body 1, a needle swing drive shaft 20 is disposed in parallel to the cam drive shaft 11 and is rotatably journaled by a bearing 45; and, the base end portion of a guide plate 46 is unrotatably fixed to the rear end face of the needle swing drive shaft 20 by a screw 47. And, to the neighboring portion of the tapered leading end portion of the guide plate 46, there is fixed a guide shaft 48 which projects in parallel to the axial direction of the needle swing drive shaft 20. Further, on the outer peripheral surface of the needle swing drive shaft 20, as shown in FIG. 2, there are erected a pair of positioning pins 49*a* and 49*b* which are spaced apart by a desired distance from each other; and, in particular, the pins 49*a* and 49*b* serve as cam body positioning means 49 which is used to restrict the moving position of a cam body 50 to be discussed later.

Figure 4:
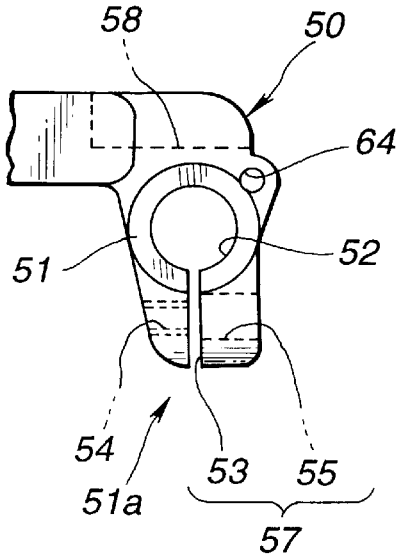
FIG. 4 is a front view of the neighboring portion of the base end portion of a cam body shown in FIG. 1.

In the neighboring portion of the rear end portion of the needle swing drive shaft 20, there is supported the base portion 51 of a cam body 50 which includes a pair of cam arms 18*a* and 18*b*, while the structure of the base portion 51 is shown in FIG. 3. In FIG. 4, in the base portion 51, there is formed a mounting hole 52 through which the needle swing drive shaft 20 is allowed to extend and, downwardly of the mounting hole 52, there is formed a slit 53 which communicates with the mounting hole 52, thereby providing a forked portion 51*a*. In one section of the forked portion 51*a*, there is formed a female screw hole 54 and, in the other section, there is formed a bolt hole 55 which is coaxial with the female screw hole 54. As shown in FIG. 1, if the slit 53 is narrowed by a clamp screw 56 which is inserted through the bolt hole 55 and screwed into the female screw hole 54, then the cam body 50 can be fixed to the needle swing drive shaft 20. On the other hand, if the clamp screw 56 is loosened, then the slit 53 is widened to thereby cause the cam body 50 to be loosely fitted with the needle swing drive shaft 20, so that the cam body 50 can be moved in the axial direction of the needle swing drive shaft 20.

The above-mentioned slit 53, female screw hole 54, bolt hole 55 and clamp screw 56 cooperate together in forming fixing means 57 which is able to fix the cam body 50 according to the present embodiment to the needle swing drive shaft 20.

By the way, the fixing means 57 may be provided as the design concept of a sewing machine or the structure of a sewing machine requires the provision of the fixing means 57; for example, when changing the needle swing pattern automatically, that is, when moving the cam body 50 automatically along the outer peripheral surface of the needle swing drive shaft 20 by means of drive means such as a pulse motor or the like, it is preferable to employ a structure in which the fixing means 57 is not provided.

In FIG. 4, in the upper portion of the base portion 51 of the cam body 50, there is formed an operation groove 58 which has a U-shaped plane and is opened upwardly as well as laterally on the right. Into this operation groove 58, as shown in FIGS. 1 and 2, there is fitted an operation pin 61 which is provided on and projected downwardly from the lower end of an operation arm 60 provided in operating means 59.

The change lever shaft 59*a* of the operating means 59 is rotatably supported on the upper machine frame of the sewing machine main body 1; and, to the operating means 59, there is connected a horizontal change lever 62 serving as an operation part which allows the change lever 59 to be operated from outside the machine frame of the sewing machine main body 1.

The operation groove 58 and operating means 59 cooperate together in forming a moving mechanism 63 which is used to move the cam body 50 in the axial direction of the needle swing drive shaft 20 when changing the needle swing pattern according to the present embodiment.

That is, when changing the needle swing pattern, by operating the change lever 62 by hand or by other similar means, the operation pin 61 is rotated about the center of the change lever shaft 59*a* of the change lever 59, thereby being able to move the cam body 50 in the axial direction of the needle swing drive shaft 20.

By the way, the installation position of the change lever 62 serving as an operation part may be decided depending on the design concept of a sewing machine or the structure of a sewing machine; and, the drive arm 62 may be installed to the outside of the sewing machine main body 1 or to the inside thereof.

In FIG. 4, diagonally upward right of the mounting hole 52 of the base portion 51, there is formed a guide hole 64 into which, as shown in FIGS. 1 and 2, the guide shaft 48 is fitted in such a manner that it can be moved in the axial direction of the needle swing drive shaft 20.

Figure 5:
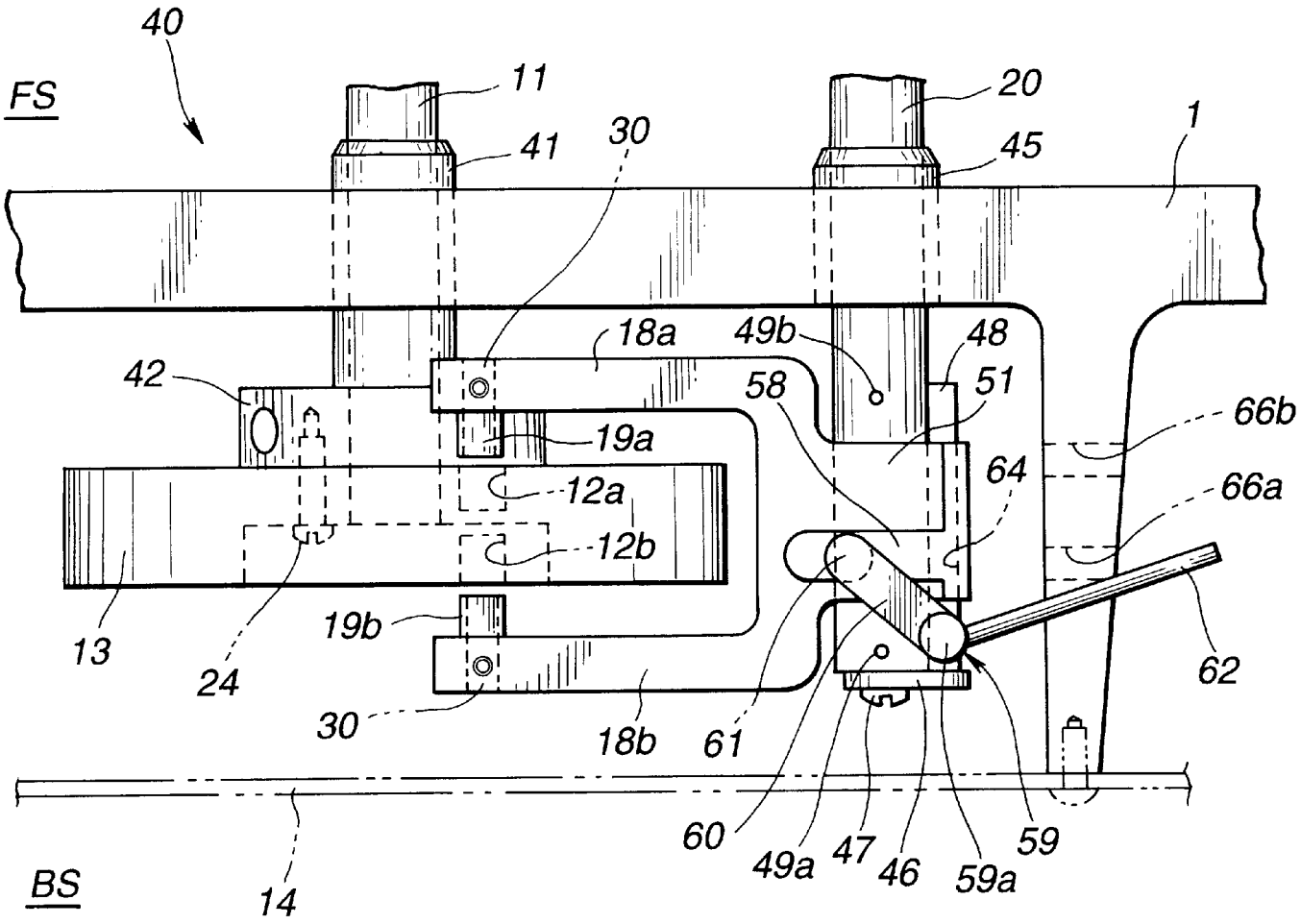
FIG. 5 is a similar view to FIG. 2, showing the moving state of the cam body shown in FIG. 1.

As shown in FIG. 2, in the respective leading end portions of the two cam arms 18*a* and 18*b* of the cam body 50, there are projectingly provided cam rollers 19*a* and 19*b* in such a manner that their respective leading ends are opposed to each other; and, the cam rollers 19*a* and 19*b* can be engaged with the cam grooves 12*a* and 12*b* of the needle swing cam 13. Also, the mutual distance between the two cam rollers 19*a* and 19*b* is set wide so as to have a non-engagement state referred to as a neutral state in which, on the way to move the cam body 50 along the axial direction of the needle swing drive shaft 20 by means of the moving mechanism 63, as shown in FIG. 5, the cam rollers 19*a* and 19*b* are not engaged with any one of the cam grooves 12*a* and 12*b* of the needle swing cam 13.

Figure 6:
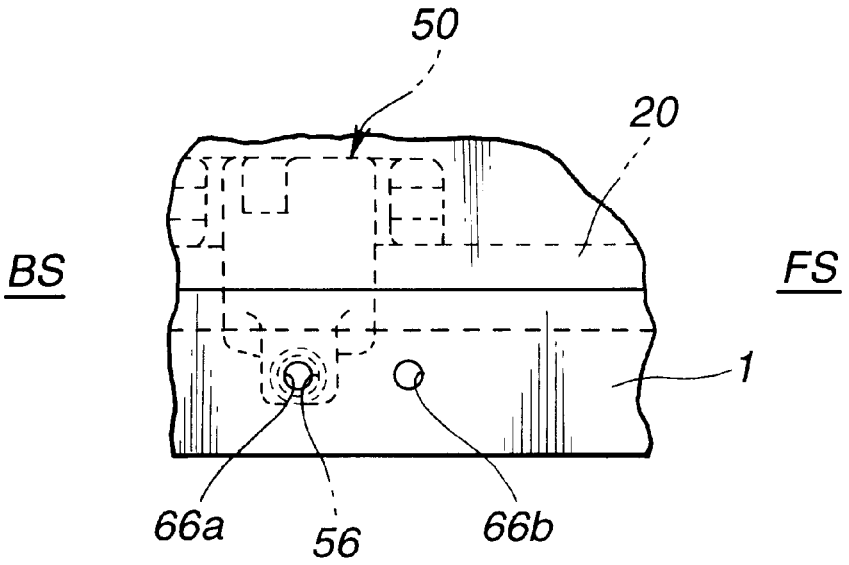
FIG. 6 is an omitted side view of FIG. 2.

Now, in FIGS. 1 and 2, the sewing machine main body 1 includes a rib 1*a* which is formed so as to form the above-mentioned space portion 1A where the needle swing cam 13 is disposed. And, in the rib 1*a*, there are formed a pair of operation holes 66*a* and 66*b* in such a manner that they respectively extend through the rib 1*a*; and also, the operation holes 66*a* and 66*b* are structured such that the clamp screw 56 can be inserted therethrough and can be screwed or tightened by a driver, a wrench, or the like. Also, the operation holes 66*a* and 66*b* are disposed such that any one of them can be situated coaxially with the bolt hole 55 and female screw hole 54 of the cam body 50 at a position where one of the cam rollers 19*a* and 19*b* is engaged with one of the cam grooves 12*a* and 12*b* of the needle swing cam 13. That is, in a state in which the cam roller 19*a* is engaged with the cam groove 12*a*, as shown in FIG. 6, the clamp screw 56 is situated on the extension of the operation hole 66*a* which is located on the rear side BS, so that the clam screw 56 can be operated only through the operation hole 66*a*. Also, in a state in which the cam roller 19*b* is engaged with the cam groove 12*b*, the clam screw 56 can be operated only through the operation hole 66*b* which is located on the front side FS.

Also, as shown in FIG. 1, on the left of the base portion 51 of the cam body 50, there is disposed a screw position restrict member 67 which is opposed to the leading end of the clamp screw 56 and has a length substantially equal to at least the moving area of the leading end of the clamp screw 56. The screw position restrict member 67 includes a recessed portion 68 which, in a fastened or tightened state, is separated from the leading end of the clamp screw 56 in order that the clamp screw 56 forming the fixing means 57 can be tightened only at a position where one of the pair of cam rollers 19*a* and 19*b* is selectively engaged with one of the cam grooves 12*a* and 12*b* of the needle swing cam 13, and a projecting portion 69 which is projected toward the leading end of the clamp screw 56 so that, when one of the pair of cam rollers 19*a* and 19*b* is situated in a non-engagement position with respect to the cam grooves 12*a* and 12*b* of the needle swing cam 13, the clamp screw 56 cannot be tightened. Also, the screw position restrict member 67 is fixedly secured to the inner wall of the sewing machine main body 1 directly or through a support member (not shown).

The two operation holes 66*a*, 66*b* and screw position restrict member 67 cooperate together in forming safety securing means 70.

By the way, the safety securing means 70 may be structured such that only one of the operation holes 66*a*, 66*b* and screw position restrict member 67 are used, in accordance with the provision position of the zigzag pattern changing device 40 depending on the design concept and the structure of a sewing machine.

Also, the operation holes 66*a* and 66*b* forming the safety securing means 70 are not formed directly in the inner wall of the sewing machine main body 1 but may be formed in a support member (not shown) fixed to the inner wall of the sewing machine main body 1, in accordance with the provision position of the zigzag pattern changing device 40 depending on the design concept and the structure of a sewing machine.

In the cam cover 14 for covering the needle swing cam 13 from outside the sewing machine, there is formed a peephole 71 which allows a movable matching mark 44 formed on the rear end face of the cam drive shaft 11 to be visually observed from outside the sewing machine; and, in the periphery of the peephole 71, there is formed a fixed matching mark 72. The fixed matching mark 72 is formed at a position where it can stand in the same straight line with the movable matching mark 44 formed on the rear end face of the cam drive shaft 11 when the switching point SP of the needle swing cam 13 is situated at the provision position of the cam rollers 19*a* and 19*b*.

The above-mentioned movable and fixed matching marks 44 and 72 cooperate together in forming switch position display means 43.

By the way, as the shape of the movable and fixed matching marks 44 and 72, any suitable shape can be selected from various shapes including a round shape, a triangular shape, a square shape, a straight line, a double line and the like.

Also, the movable matching mark 44 may also be formed at an arbitrary position on this side (in FIG. 1) surface of the needle swing cam 13. In this case, the position of the peephole 71, which is formed in the cam cover 14 and includes the fixed matching mark 72 therein, may be decided according to the formation position of the movable matching mark 44.

Further, the fixed matching mark 72 may also be formed on the end face of the cam body 50 on this side (in FIG. 1). In this case, the movable matching mark 44 may be formed on this side end face of the needle swing cam 13 according to the formation position of the fixed matching mark 72 and, at the same time, in the cam cover 14, there may be formed a simple peephole 71 through which the switch position display means 43 can be visually confirmed from outside the sewing machine. Also, in this case, with the cam cover 14 removed from the sewing machine main body 1, the switch point SP can be found.

And, the movable matching mark 44 may also be formed in the neighborhood of the outer peripheral edge of this side end face of the needle swing cam 13, and the fixed matching mark 72, which is formed as an independent indicator, may be disposed in the interior portion of the sewing machine main body 1 that is located near the neighborhood of the outer periphery of the needle swing cam 13; that is, the movable and fixed matching marks 44 may be positioned side by side. In this case, in the cam cover 14, there may be formed a simple peephole 71 through which the switch position display means 43 can be visually confirmed from outside the sewing machine. Also, in this case, with the cam cover 14 removed from the sewing machine main body 1, the switch point SP can be found.

Figure 7:
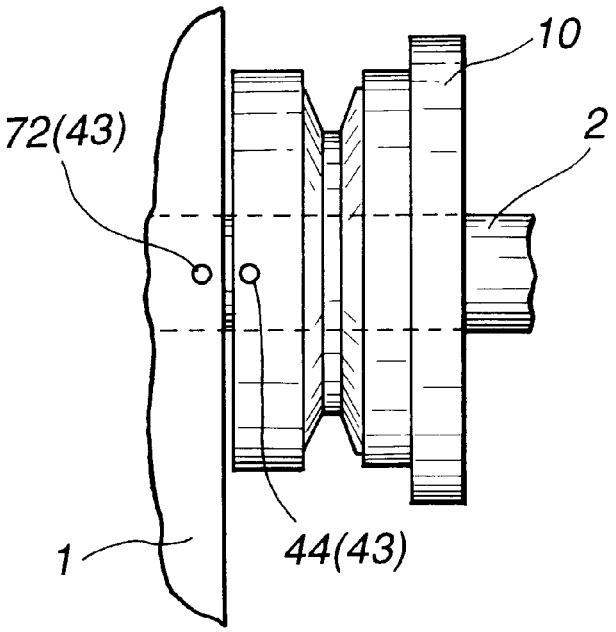
FIG. 7 is an explanatory view of the main portions of another embodiment of switch position display means provided in a sewing machine zigzag pattern changing device according to the invention.

Also, since the needle swing cam 13 is decelerated with respect to the upper shaft 2, as shown in FIG. 7, if the movable matching mark 44 is provided in the upper pulley 10 and the fixed matching mark 72 is provided in the portion of the sewing machine main body 1 that is located near the upper pulley 10, then a more accurate switch point SP can be found with ease.

Further, if the switch point SP is set at a needle drop position which is present at least at one end in the needle swing width direction, that is, if the switch point SP is set such that it is situated at a needle drop position which is present at the left- or right-most end of a needle, when changing the needle swing pattern, it is easy for an operator to judge and find the left- or right-most end needle drop position in the needle swing width direction of the needle, so that the switch point SP of the needle swing cam 13 can be positioned more easily by an operator's simple operation. As a result of this, the reduced labor and improved operation efficiency when changing the needle swing pattern can be attained with ease. In this case, it is not always necessary to provide the above-mentioned switch position display means 43.

By the way, the structure, in which the switch point SP is set at a needle drop position at least at one end in the needle swing width direction, can apply not only to the sewing machine zigzag pattern changing device 40 according to the invention but also to various kinds of conventional sewing machine zigzag pattern changing devices including a device of a type that the needle swing cam 13 is replaced.

Figure 8:
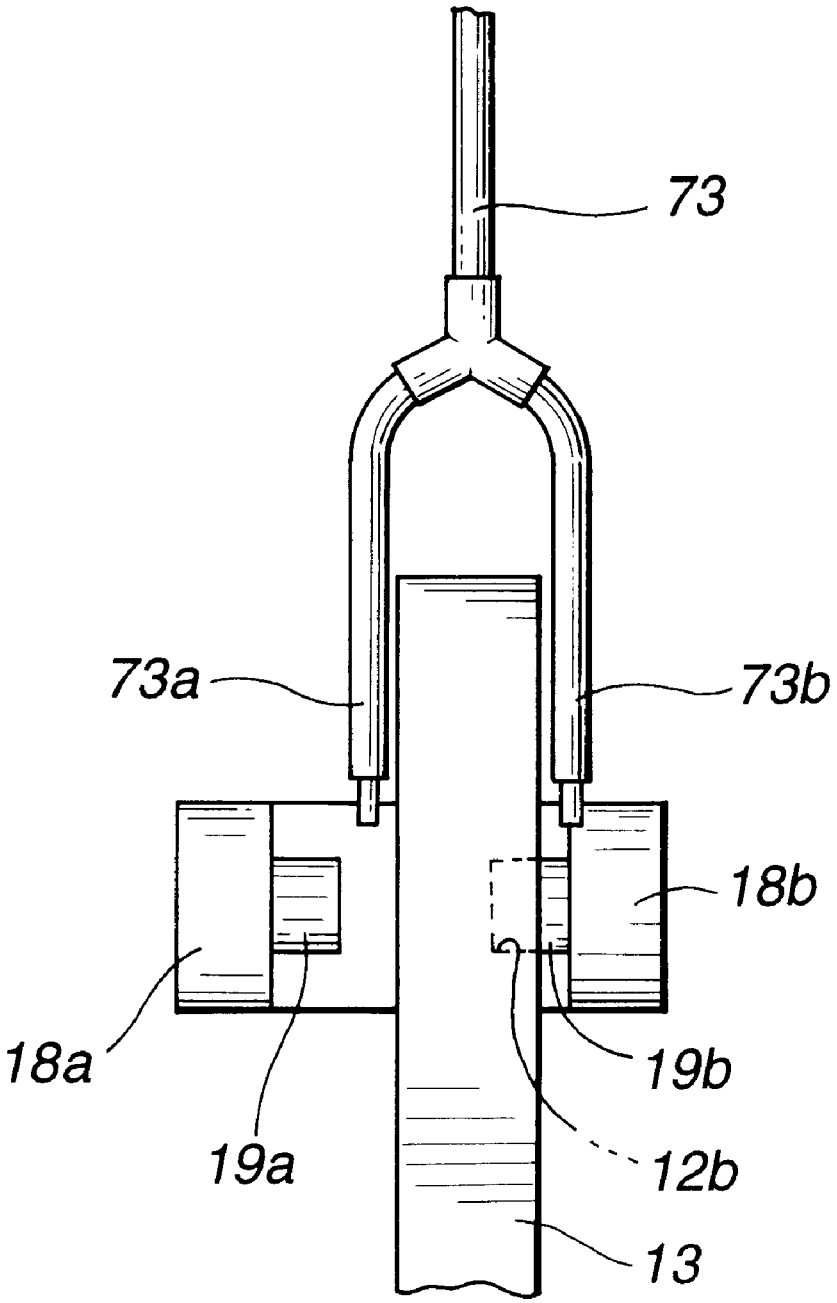
FIG. 8 is an explanatory view of the positional relation between oil drop supply means and cam roller shown in FIG. 1.
Figure 9:
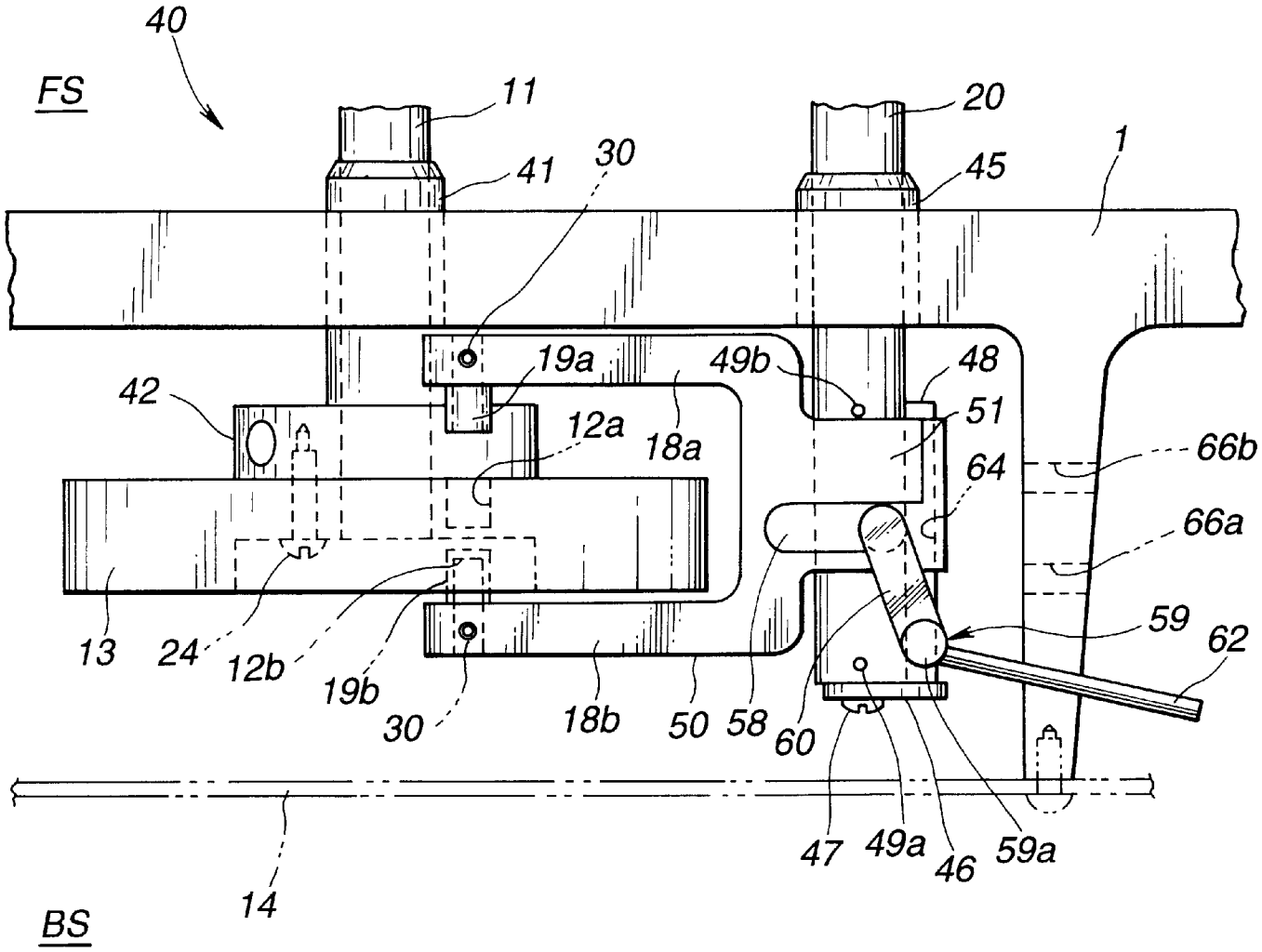
FIG. 9 is a similar view to FIG. 2 of a sewing machine zigzag pattern changing device according to the invention, showing a sewable state thereof in which the other cam roller is in engagement with the other cam groove to thereby be able to form the other needle swing pattern.

Also, as shown in FIG. 1, upwardly of the provision position of the above-mentioned needle swing cam 13 which has been assembled in a vertical manner, there is disposed oil drop supply means 73. The oil drop supply means 73, as shown in FIG. 8, includes tubes 73*a* and 73*b* which are respectively capable of dropping oil previously sucked up by a lubricating pump (not shown) down to the cam rollers 19*a* and 19*b* engageable with the cam grooves 12*a* and 12*b* formed in the needle swing cam 13. And, the oil drop supply means 73 is structured such that, by moving the cam body 50 along the axial direction of the needle swing drive shaft 20 by means of the moving mechanism 63, it forcibly supply the above oil to one of the cam rollers 19*a* and 19*b* engaged with the cam groove 12*a* or 12*b*.

That is, in a state where the oil can be dropped from the tube 73*a* down to the cam roller 19*a* engaged with the cam groove 12*a*, the oil cannot be dropped from the other tube 73*b* down to its corresponding cam rollers 19*b*; but, when the cam body 50 is moved and the cam roller 19*b* is thereby engaged with the cam groove 12*b*, oppositely to the above case, the oil can be dropped from the tube 73*b* down to the cam roller 19*b* engaged with the cam groove 12*b*, whereas the oil cannot be dropped from the other tube 73*a* down to its corresponding cam roller 19*a*.

The remaining portions of the present embodiment are similar in structure to the previously described conventional device and thus the description thereof is omitted here.

Next, description will be given below of the operation of the present embodiment having the above-mentioned structure with reference to FIGS. 1, 2, 5, 8, 9 and 10.

As shown in FIG. 2, in a state where the cam roller 19*a* of one cam arm 18*a* of the cam body 50 is in engagement with one cam groove 12*a*, if the cam drive shaft 11 is driven or rotated through the lower shaft (not shown), then the needle swing cam 13 is driven or rotated and the cam roller 19*a* is rotated with the rotation of the cam groove 12*a* which can be rotated with the rotation of the needle swing cam 11, thereby causing the cam body 50 to swing; and, the swing motion of the cam body 50 drives or rotates the needle swing drive shaft 20 to move the needle bar in the horizontal direction through a needle swing drive arm, a needle swing rod, a needle swing drive link, and a needle swing shaft (none of which are not shown), thereby executing a needle swing operation, so that a desired needle swing pattern such as a two-dot zigzag shown in FIG. 31 or the like can be formed.

Since the needle swing drive shaft 20 is clamped by the fixing means 57, the rigidity of the connecting portion between the cam body 50 and needle swing drive shaft 20 can be remarkably enhanced. As a result of this, the reliability of the connecting portion between the cam body 50 and needle swing drive shaft 20 can be secured positively over a long period of time.

When the clamp screw 52 is loosened, since the guide shaft 48 is fitted with the guide hole 64, the cam body 50 can be prevented from rotating about the needle swing drive shaft 20 and, at the same time, the swing motion of the cam body 50 can be transmitted to the needle swing drive shaft 20 positively. And, because the guide shaft 48 and guide hole 64 can be machined easily with high precision due to the fitting engagement between a shaft and a hole, a clearance between the guide shaft 48 and guide hole 64 can be reduced easily to thereby be able to minimize the loosened state or play of the needle swing drive shaft 20 in the rotation direction thereof that can be produced between the cam body 50 and needle swing drive shaft 20, and thus the play of the needle bar in the right and left direction, with the result that the sewing quality of the sewing machine can be enhanced. In this manner, if the clearance between the guide shaft 48 and guide hole 64 is reduced, then there is a possibility that the guide shaft 48 and guide hole 64 can be closely contacted with each other to thereby make it impossible to move the cam body 50 smoothly in the axial direction of the needle swing drive shaft 20. Therefore, in order to prevent such inconvenience, preferably, in at least one of the guide shaft 48 and guide hole 64, there may be formed a ventilating recessed portion which extends in the axial direction thereof.

Next, description will be given below of an operation to be executed when switching the needle swing operation over to a needle swing operation using the other cam groove 12*b* which is situated in the lower portion of FIG. 2 of the needle swing cam 13, that is, an operation to be executed when changing the needle swing pattern.

When changing the needle swing pattern, the engagement of the cam roller 19*a* in engagement with the cam groove 12*a* of the needle swing cam 13 is removed and the other cam roller 19*b* is engaged with the other cam groove 12*b* of the needle swing cam 13. In this operation, as described above, such engagement switching operation must be carried out at the switch point SP of the needle swing cam 13, that is, at a phase where the needle swing cam 13 can be switched while the above-mentioned pair of cam rollers 19*a* and 19*b* are respectively opposed to the cam grooves 12*a* and 12*b* of the needle swing cam 13.

In view of this, the movable matching mark 44 and fixed matching mark 72, which cooperate together in forming the switch position display means 43, are set such that they are situated on a straight line respectively. Thanks to this, unlike the conventional sewing machine zigzag pattern changing devices, the switch point SP of the needle swing cam 13 can be matched easily to the provision positions of the respective cam rollers 19*a* and 19*b*. As a result of this, not only the labor and time necessary to find out the switch point SP of the needle swing cam 13 when changing the needle swing pattern can be reduced, but also the efficiency of the operation when changing the needle swing pattern can be enhanced.

After the switch point SP is found, the cam cover 14 located on the rear side BS is removed from the sewing machine main body 1. And, as shown in FIG. 6, in a state where the cam roller 19*a* is engaged with the cam groove 12*a*, since the clamp screw 56 is situated on the extension of the operation hole 66*a*, if the clamp screw 56 in threaded engagement with the female screw hole 54 forming the fixing means 57 is loosened by inserting an operation tool such as a driver or a wrench (neither of which are shown) through the operation hole 66*a*, then the cam body 50 can be moved in the axial direction along the outer peripheral surface of the needle swing drive shaft 20, as described before.

Next, the change lever 62 of the operating means 59 forming the moving mechanism 63 is operated toward the lower portion of FIG. 2. Due to this operation, the change lever 59 is rotated clockwise (in FIG. 2) about the base portion 59*a* thereof, while the operation pin 61 in engagement with the operation groove 58 moves the cam body 50 upwardly on the needle swing drive shaft 20. And, the cam roller 19*a*, which has been in engagement with the cam groove 12*a* to that time, is firstly removed from the cam groove 12*a* and, after then, the other cam roller 19*b* is engaged with the cam groove 12*b*, and the end face of the base portion 51 of the cam body 50 situated in the upper portion of FIG. 2 is stopped at a position where it is butted against the positioning pin 49*b*, thereby providing a state shown in FIG. 9.

Next, the clamp screw 56 is tightened by a tool and, after then, the cam cover 14 is mounted onto the sewing machine main body 1, thereby completing the needle swing pattern changing operation. And, in a state where the cam roller 19*b* is in engagement with the cam groove 12*b*, if the cam drive shaft 11 is driven or rotated, then the needle swing cam 13 is driven or rotated and the cam roller 19*b* is rotated with the rotation of the cam groove 12*b*, thereby causing the cam body 50 to swing; and, the swing motion of the cam body 50 drives or rotates the needle swing drive shaft 20 to move the needle bar in the horizontal direction through a needle swing drive arm, a needle swing rod, a needle swing drive link, and a needle swing shaft (none of which are not shown), thereby executing a needle swing operation, so that a desired needle swing pattern such as a four-dot zigzag shown in FIG. 50 or the like can be formed.

At the time, while the cam body 50 moves on the needle swing drive shaft 20, the guide hole 64 formed in the cam body 50 is guided along the guide shaft 48 provided in the needle swing drive shaft 20 and is thereby moved in the axial direction of the needle swing drive shaft 20, so that the cam body 50 can be moved smoothly in the axial direction of the needle swing drive shaft 20. Also, the cam body 50 moves on the needle swing drive shaft 20 in a two-point supported manner, that is, at the contact portion thereof between the mounting hole 52 of the cam body 50 and the outer peripheral surface of the needle swing drive shaft 20 which are loosely fitted with each other, and at the contact portion thereof between the guide hole 64 of the cam body 50 and the guide shaft 48 of the needle swing drive shaft 20 which are fitted with each other. Due to this, the assembling phase of the needle swing drive shaft 20 and cam body 50 varies little, which makes it possible to prevent the cam rollers 19*a* and 19*b* respectively provided in the cam body 50 from varying in position.

The fitting engagement between the guide shaft 48 and guide hole 64 not only can reduce the loosened state or play of the needle swing drive shaft 20 in the rotation direction thereof occurring between the cam body 50 and needle swing drive shaft 20 and thus the play of the needle bar in the right and left direction to thereby prevent the cam body 50 from rotating about the needle swing drive shaft 20, but also causes the assembling phase of the needle swing drive shaft 20 and cam body 50 to vary little when the cam body 50 mounted on the needle swing drive shaft 20 moves on the needle swing drive shaft 20 in the axial direction thereof. Due to this, unlike the conventional structure, the respective cam rollers 19*a* and 19*b* are prevented from varying in position, so that the efficiency of the operation to change the needle swing pattern can be enhanced further.

Also, since the present zigzag pattern changing device is structured such that it has a non-engagement state, that is, a neutral state in which, when changing the needle swing pattern, in the middle of moving the cam body 50 along the axial direction of the needle swing drive shaft 20 by the moving mechanism 63, as shown in FIG. 5, the pair of cam rollers 19*a* and 19*b* are not engaged with either of the pair of cam grooves 12*a* or 12*b*, the present zigzag pattern changing device can be prevented easily against breakage when the cam body 50 is moved insufficiently because of a mistake made by an operator.

Further, because there is provided safety securing means 70 which comprises the pair of operation holes 66*a* and 66*b* and the like, when changing the needle swing pattern, in the middle of moving the cam body 50 along the axial direction of the needle swing drive shaft 20 by the moving mechanism 63, the clamp screw 56 is prevented against operation, which makes it possible to prevent the present zigzag pattern changing device easily and positively against breakage when the movement of the cam body 50 is insufficient because of a mistake made by an operator.

Figure 10:
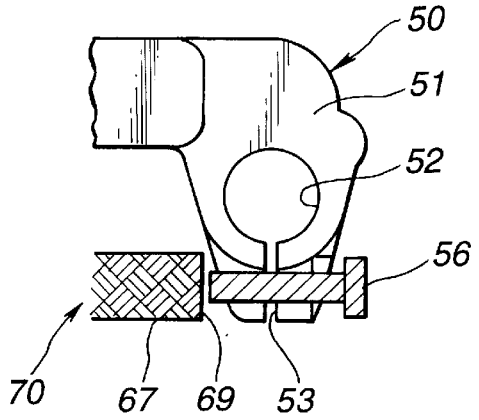
FIG. 10 is an explanatory view of a sewing machine zigzag pattern changing device according to the invention, showing a state thereof in which a clamp screw used as part of fixing means is not tightened in the middle of the movement of a needle swing cam when changing the needle swing pattern.
Figure 11:
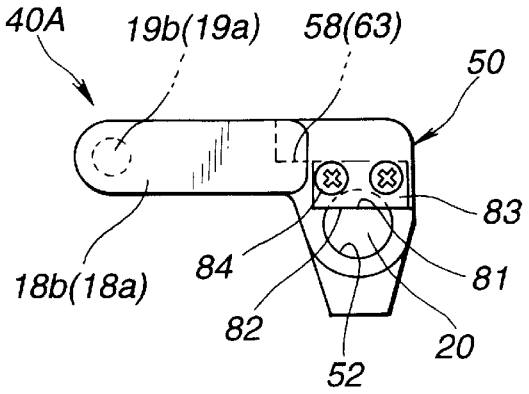
FIG. 11 is a front view of the main portions of a second embodiment of a sewing machine zigzag pattern changing device according to the invention.
Figure 12:
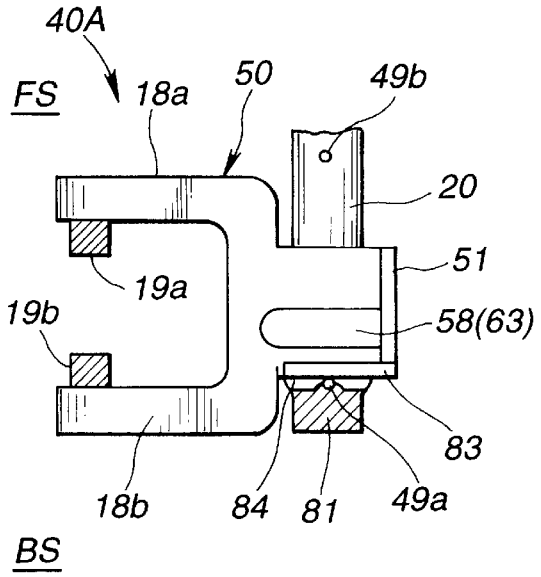
FIG. 12 is a plan view of FIG. 11.

Still further, because there is provided safety securing means 70 which comprises the position restrict member 67 and the projecting portion 69 thereof, when changing the needle swing pattern, in the middle of moving the cam body 50 along the axial direction of the needle swing drive shaft 20 by the moving mechanism 63, as shown in FIG. 10, it is impossible to tighten the clamp screw 56 by use of the projecting portion 67 of the position restrict member 67, which makes it possible to prevent the present zigzag pattern changing device easily and positively against breakage when the movement of the cam body 50 is insufficient because of a mistake made by an operator.

Moreover, in a state where the engagement of the cam roller 17*a* in engagement with one cam groove 12*a* of the needle swing cam 13 is removed, if an operator touches the needle bar or upper shaft pulley 10 by mistake, then the needle swing cam 13 is rotated to thereby shift the phase of the switch point SP, which makes it impossible to bring the other cam roller 17*b* into engagement with the cam groove 12*b* easily. However, since the switch point SP of the needle swing cam 13 can be found easily by the switch position display means 43, not only the efficiency of the operation to change the needle swing pattern can be improved positively but also a wrong assembly due to the above-mentioned wrong operation can be restored easily.

And, as shown in FIG. 8, the oil is dropped down and spplied to the cam rollers 19*a* and 19*b* from above by the oil drop supply means 73, that is, the oil drop is forcibly supplied to the cam rollers 19*a* and 19*b* to thereby be able to surely supply the oil into the cam grooves 13*a* and 13*b* as well through the cam rollers 19*a* and 19*b*, so that the oil can be held between them properly. This makes it possible to prevent the cam rollers 19*a* and 19*b* and cam grooves 13*a* and 13*b* against wear which could otherwise occur due to their mutual sliding contact.

With use of the above structure, the flat surface 82 of a stopper 83 disposed in the cam body 50 slides on a plane portion 81 which is formed at least in part of the outer peripheral surface of the needle swing drive shaft 20 and extends in parallel to the axial direction of the needle swing drive shaft 20, so that the cam body 50 can be moved smoothly in the axial direction of the needle swing drive shaft 20. And, by bringing the flat surface 82 of the stopper 83 into slidable contact with the plane portion 82, the cam body 50 can be prevented from rotating about the needle swing drive shaft 20. Such slidable contact of the flat surface 82 with the plane portion 81 can also facilitates the working of the needle swing drive shaft 20 and cam body 50 as well as can reduce the loosened state or play of the needle swing drive shaft 20 in the rotation direction thereof occurring between the cam body 50 and needle swing drive shaft 20 and thus the play of the needle bar in the right and left direction thereof, which results in the improved sewing quality. Further, with use of the present structure, when the cam body 50 mounted on the needle swing drive shaft 20 moves on the needle swing drive shaft 20 in the axial direction thereof, the assembling phase of the needle swing drive shaft 20 and cam body 50 is caused to vary little.

Figure 13:
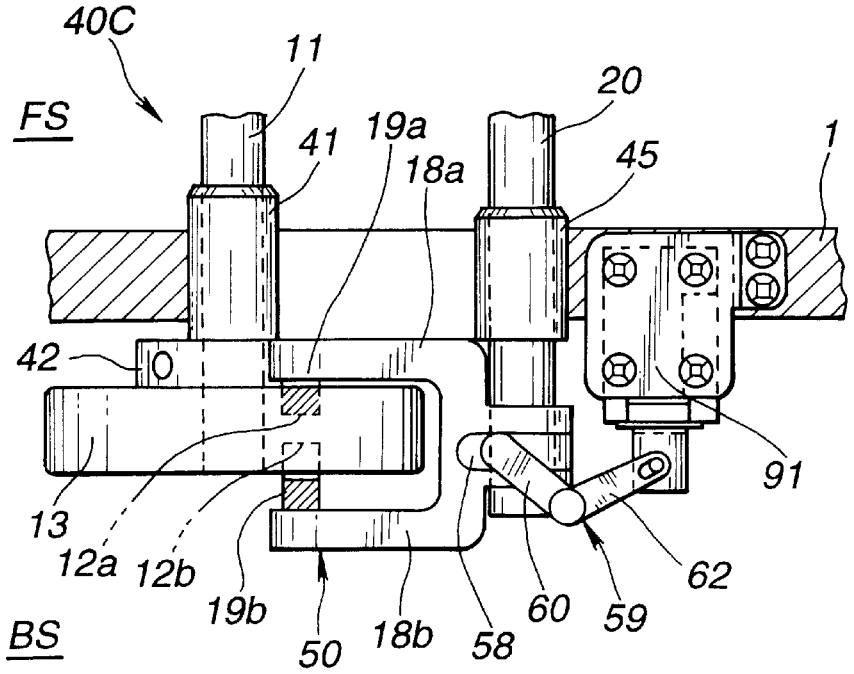
FIG. 13 is a plan view of the main portions of a third embodiment of a sewing machine zigzag pattern changing device according to the invention, showing a sewable state thereof in which one cam roller is in engagement with one cam groove to thereby be able to form one needle swing pattern.
Figure 14:
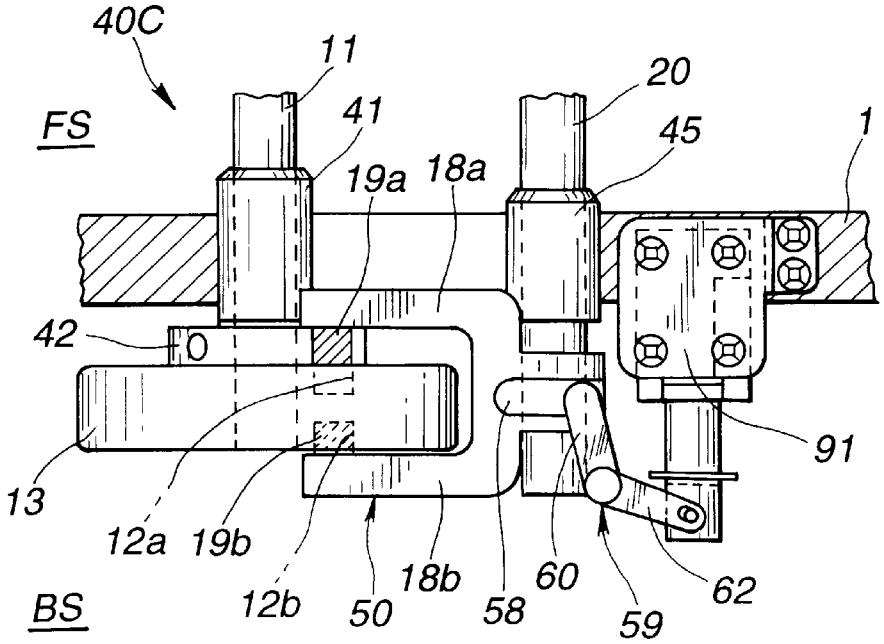
FIG. 14 is a plan view of the main portions of the third embodiment of a sewing machine zigzag pattern changing device according to the invention, showing a sewable state thereof in which the other cam roller is in engagement with the other cam groove to thereby be able to form the other needle swing pattern.

Now, description will be given below of the main portions of a third embodiment of a sewing machine zigzag pattern changing device employing an automatically movable cam body according to the invention, with reference to FIGS. 13 to 16. In particular, in a sewing machine zigzag pattern changing device 40C according to the third embodiment, the fixing means 57 and safety securing means 70 respectively employed in the previously describe first and second embodiments are not disposed. And, as shown in FIGS. 13 and 14, there is provided an actuator 91 such as a solenoid or the like which serves as drive means for driving the change lever 62 of the operating means 59 forming the above-mentioned moving mechanism 63. By the way, as the drive means, a reciprocating cylinder can also be used.

Figure 15:
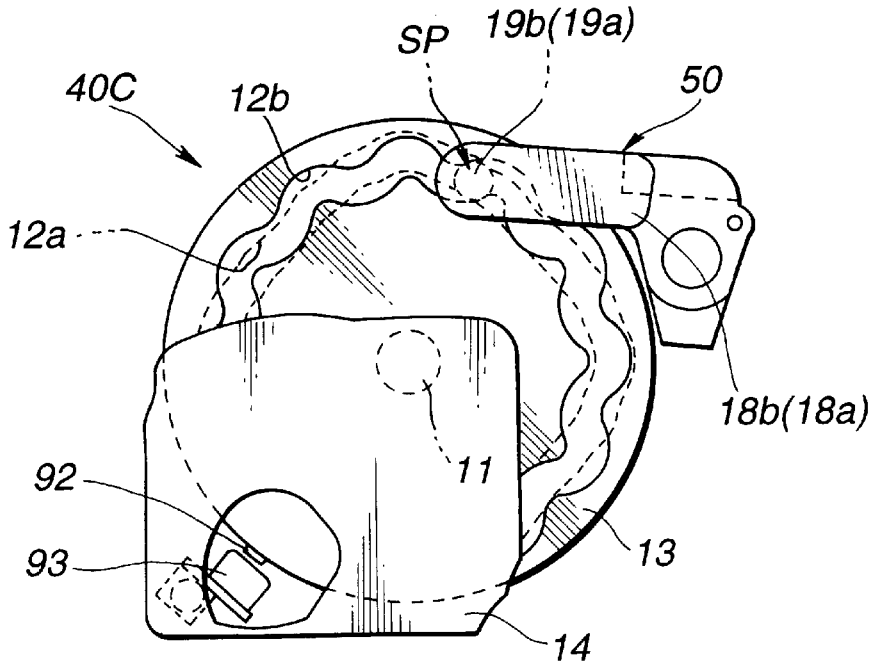
FIG. 15 is a front view of the main portions of the third embodiment of a sewing machine zigzag pattern changing device according to the invention.

On the outer peripheral surface of the needle swing cam 13, as shown in FIG. 15, there is provided a switch position marker 92 which points out the above-mentioned switch point SP; and, in the neighborhood of the needle swing cam 13, there is provided an optical sensor 93 which is used as detect means for detecting the switch position marker 92 at the switch point SP. However, as the detect means, the optical sensor 93 is not limitative but a proper device can also be selected out of various known devices such as a contact type limit switch, a non-contact type proximity switch and the like.

Figure 16:
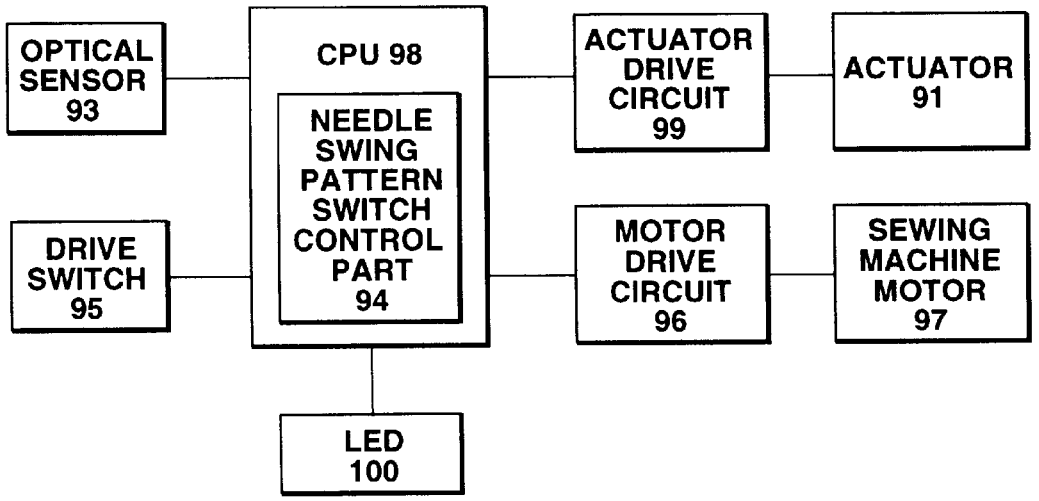
FIG. 16 is a block diagram of the third embodiment of a sewing machine zigzag pattern changing device according to the invention, explaining a needle swing pattern control part thereof.

In FIG. 16, reference character 98 designates a CPU which is used to control the operation of a sewing machine; 97 a sewing machine motor which is connected to the above-mentioned upper shaft 2; 95 a drive switch which can be operated by an operator to generate an on signal for driving the sewing machine motor 97 or an off signal for stopping the operation of the sewing machine motor 97; 94 a needle swing pattern switch control part which is stored within the CPU 98 as a program and is used to control the needle swing pattern switching operation; 96 a motor drive circuit which drives the sewing machine motor 97 at a given low speed or stop the same in accordance with an instruction from the needle swing pattern switch control part 94; 99 an actuator drive circuit which controls the actuator 91 in accordance with an instruction from the needle swing pattern switch control part 94; and, 100 an LED which displays the moving position of the cam body 50 in accordance with an instruction given from the needle swing pattern switch control part 94 to the actuator drive circuit 99.

In particular, the needle swing pattern switch control part 94 carries out the following control operations: That is, when changing the needle swing pattern, if there is input an on signal from the switch 95 as it is operated by the operator, then the control part 94 issues an instruction to the motor drive circuit 96 that the sewing machine motor 97 should be driven at the low speed, so that the upper shaft 2 is rotated and the needle swing cam 20 is thereby rotated in linking with the rotation of the upper shaft 2. If the optical sensor 93 issues a detect signal for detection of the switch position marker 92, then the control part 94 issues to the motor drive circuit 96 a signal to stop the sewing machine motor 97. After the passage of the time necessary to stop the sewing machine motor 97, the control part 94 generates to the actuator drive circuit 99 an on or off signal. Referring in particular to the generation of the on or off signal, the needle swing pattern switch control part 94 judges whether the then state is on or off and generates a signal pointing out the opposite state to the judged state.

By the way, in the above description, the control part 94 issues a signal to the actuator drive circuit 99 by confirming the passage of the time necessary to stop the sewing machine motor 97. However, this is not limitative but, alternatively, a position sensor (not shown) for detection of stopping of the sewing machine motor 97 may be provided in the sewing machine motor 97, and, when a detection signal is input into the needle swing pattern switch control part 94 from the position sensor, the control part 94 may generate a signal to the actuator drive circuit 99.

Also, referring to the display of the LED 100, a selected needle swing pattern may be displayed instead of the moving position of the cam body 50.

With use of the present structure, the needle swing pattern can be changed automatically and thus the efficiency of the operation to change the needle swing pattern can be enhanced further. Also, since the LED 100 serving as the needle swing pattern display means allows an operator to judge easily the needle swing pattern used in a sewing operation, in the first sewing operation after a new operator replaces the old operator, it is possible to prevent surely a simple mistake that the operator selects a wrong needle swing pattern.

By the way, if there is employed a structure in which a detect signal to be issued when the optical sensor 93 is detected by the switch position marker 92 is displayed by display means (not shown), then the structure can be used as the switch position display means 43 in the previously described first and second embodiments of the invention.

Figure 17:
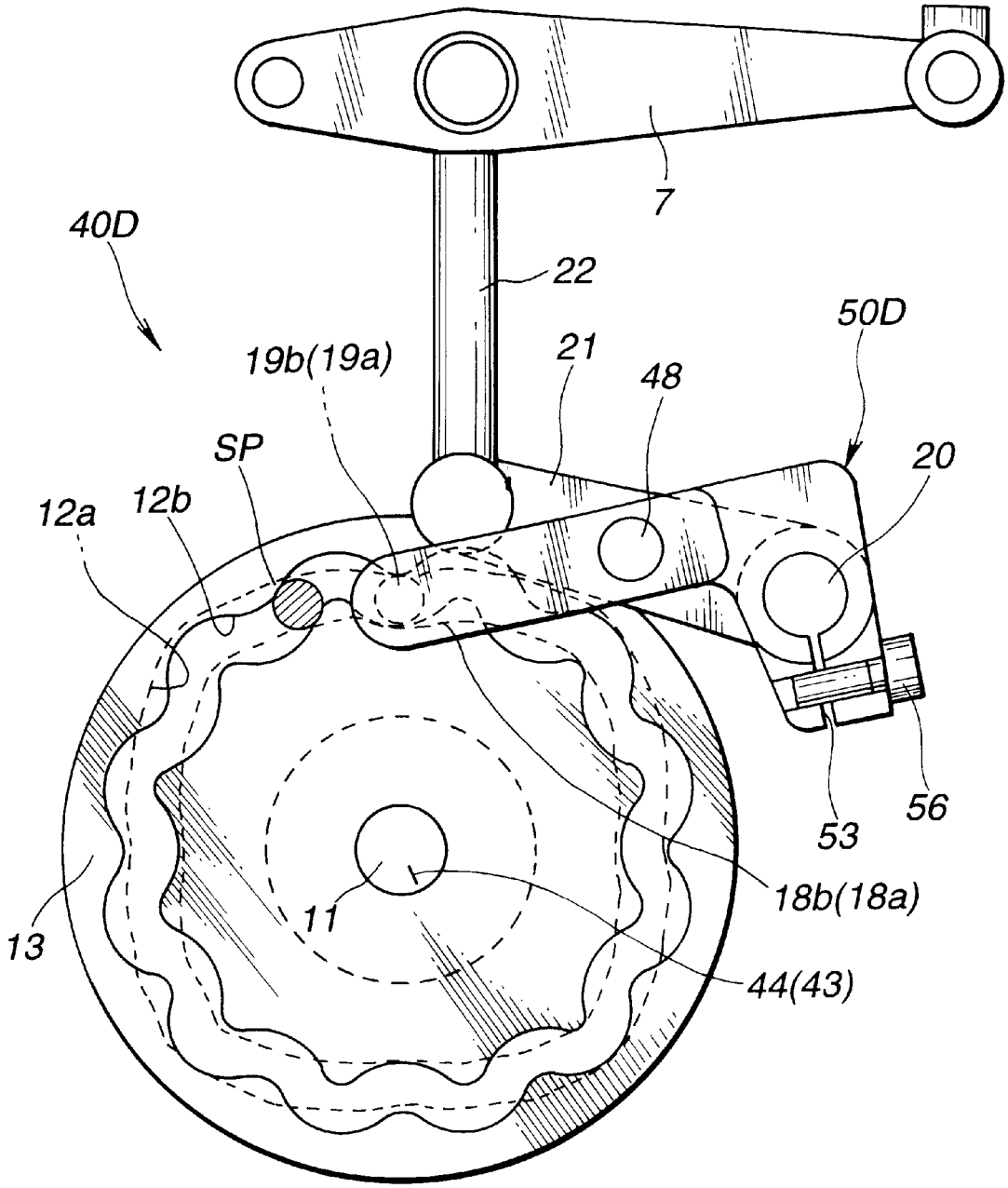
FIG. 17 is a front view of the main portions of a fourth embodiment of a sewing machine zigzag pattern changing device according to the invention.
Figure 18:
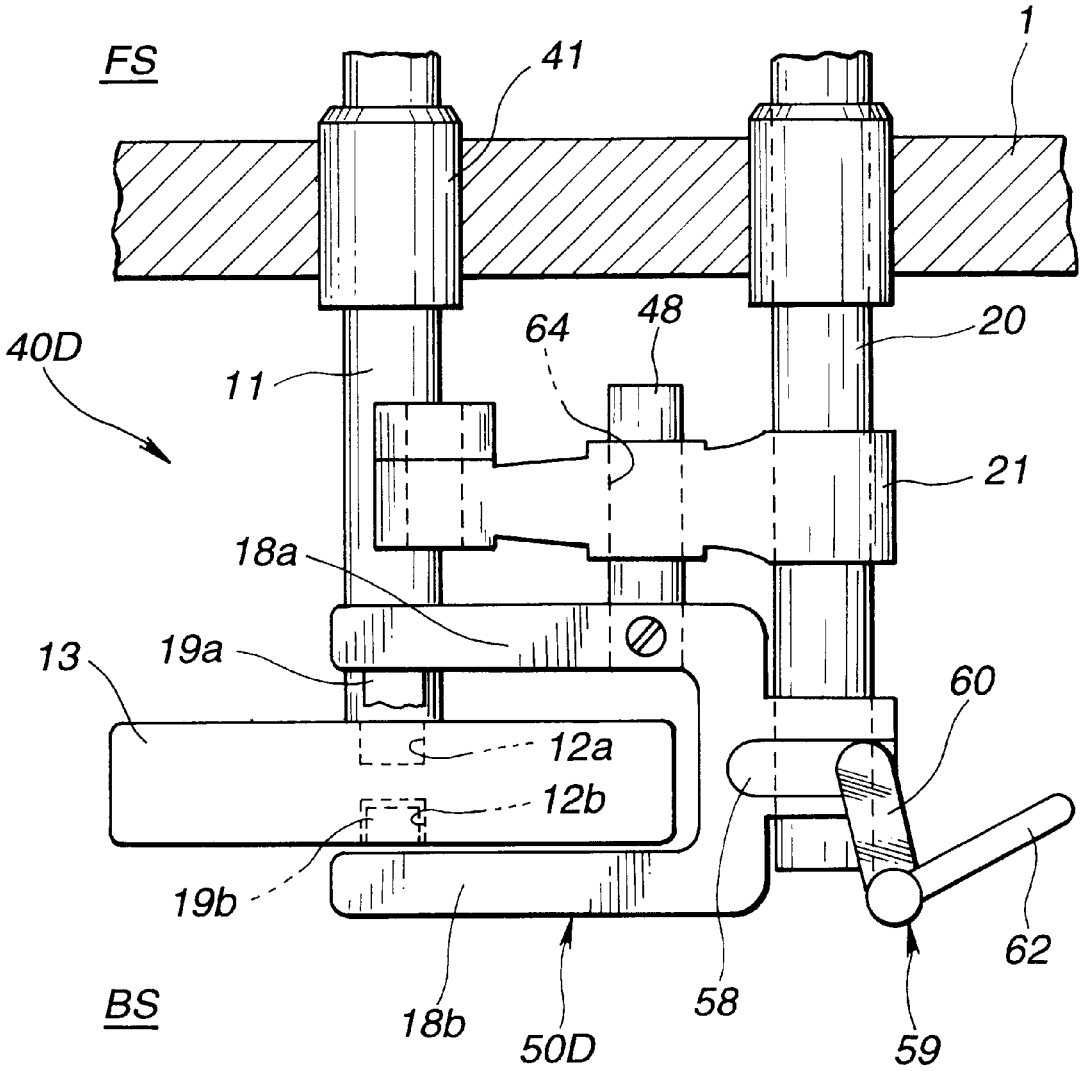
FIG. 18 is a plan view of FIG. 17.

Now, FIGS. 17 and 18 respectively show the main portions of a fourth embodiment of a sewing machine zigzag pattern changing device according to the invention. In a sewing machine zigzag pattern changing device 40D according to the fourth embodiment, the guide shaft 48 employed in the previously described first embodiment is fixed to the base end portion of a cam arm 18*a* which is situated on the inside a cam body 50D (upper potion of FIG. 17) in such a manner that the leading end of the guide shaft 48 extends toward the FS side and, at the same time, the guide hole 64 employed in the previously described first embodiment is formed between the change lever 62 and a needle swing drive arm 21. The remaining portions of the fourth embodiment are similar in structure to the previously described first embodiment.

With employment of the present structure, the present embodiment can provide not only effect that the structure with a small undesignated play in comparison with the first embodiment but also similar effects to the first embodiment.

Also, the structure of the previously described third embodiment can be added to the present embodiment singly or in combination thereof.

Figure 19:
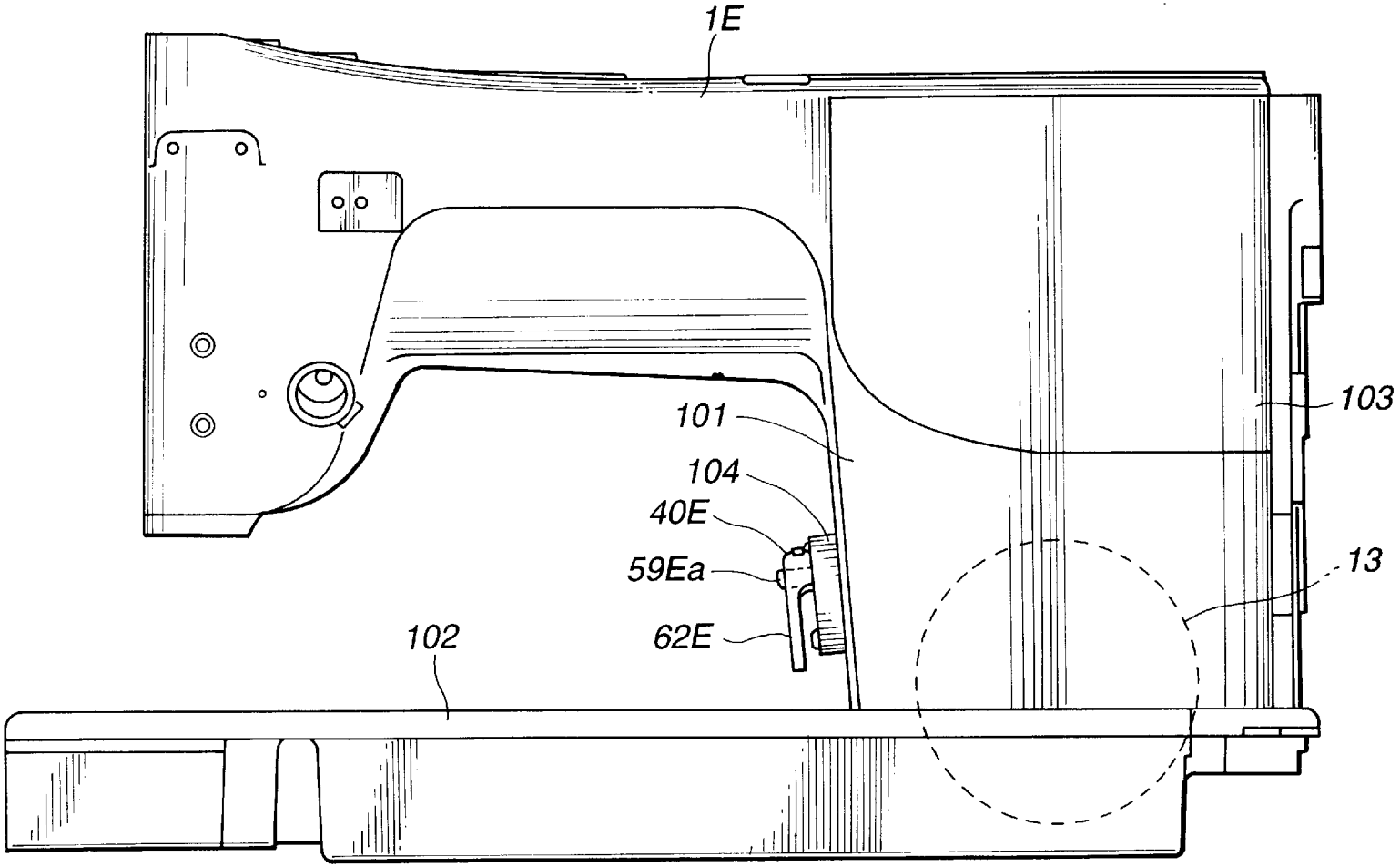
FIG. 19 is a front view of the main portions of a fifth embodiment of a sewing machine zigzag pattern changing device according to the invention.
Figure 20:
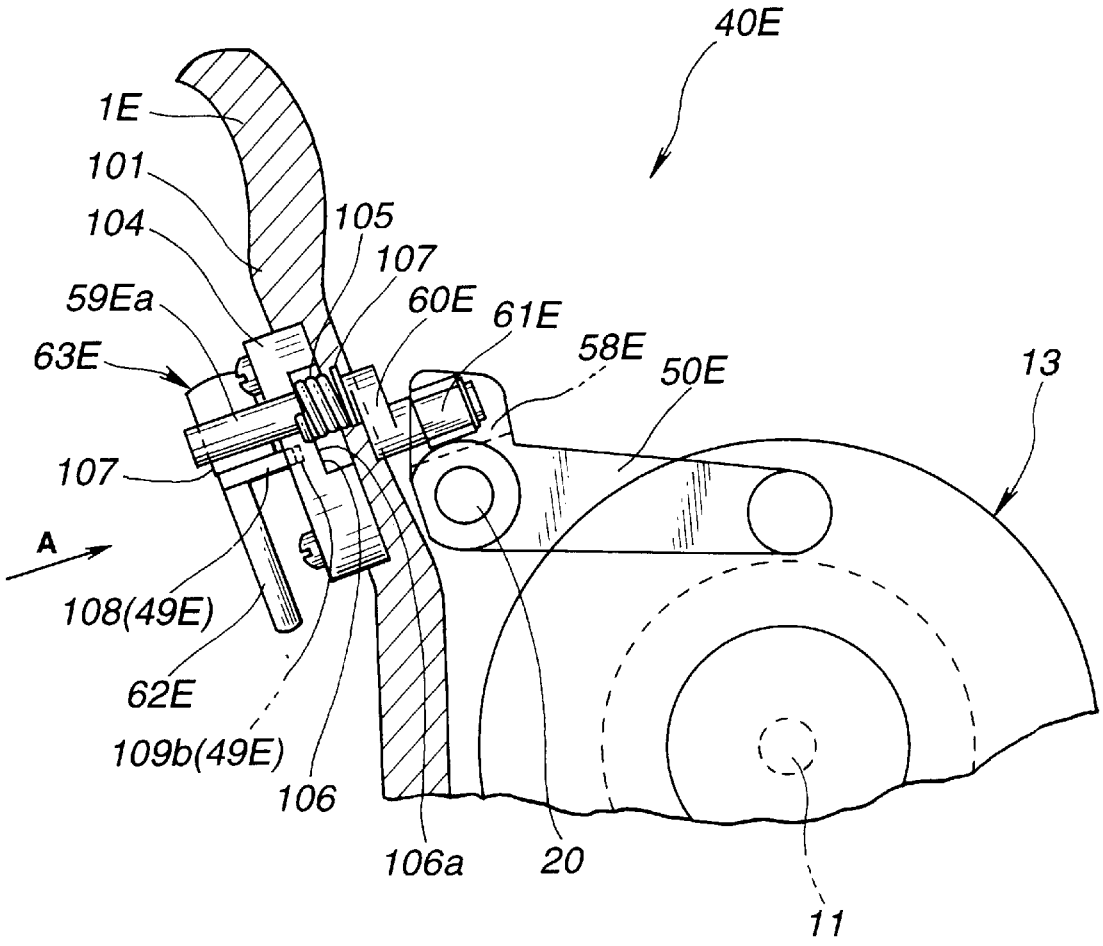
FIG. 20 is an enlarged longitudinal section view of the main portions of FIG. 19.
Figure 21:
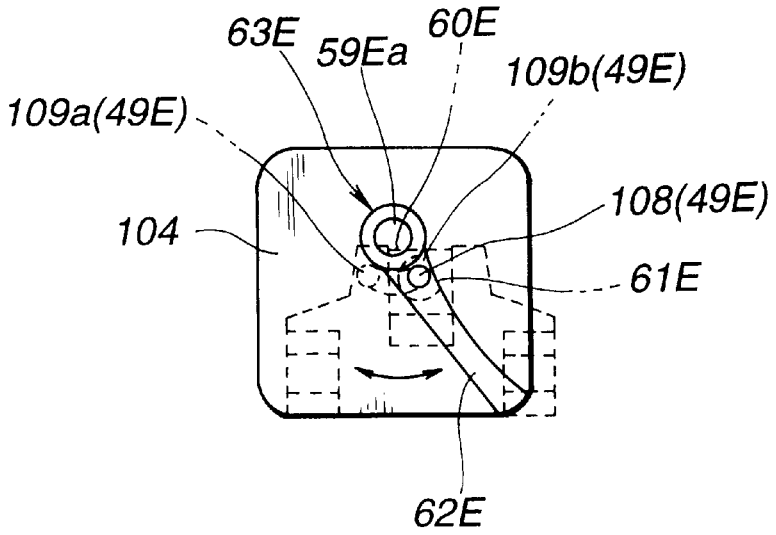
FIG. 21 is an A arrow view of FIG. 20.

Now, FIGS. 19 to 21 respectively show the main portions of a fifth embodiment of a sewing machine zigzag pattern changing device according to the invention. In a sewing machine zigzag pattern changing device 40E according to the fifth embodiment, as a part of a moving mechanism 63E according to the present embodiment, a switch lever 62E serving as an operation part which can be operated from outside a sewing machine is provided in the stud portion 101 of a sewing machine main body 1E and, at the same time, cam body positioning means 49E is provided in the stud portion 101 of the sewing machine main body 1E which can be operated from outside the sewing machine.

In more particular, in the present embodiment, as shown in FIG. 19, a moving mechanism mounting plate 104 is mounted on the stud portion 101 of the sewing machine main body 1E, more exactly, on the left side surface (i.e. inside) of the sewing machine main body 1E which is located in the neighborhood of the connecting portion between a sewing machine bed 102 and the stud portion 101. And, the change lever shaft 59E*a* is rotatably supported on the moving mechanism mounting plate 104 in such a manner that it extends through the moving mechanism mounting plate 104 and into the frame of the sewing machine body 1. Also, as shown in FIG. 20, an operation arm 60E is provided in the rear end (in FIG. 20, the right end) of the change lever shaft 59E*a* in such a manner that it extends in a direction perpendicular to an axis of the change lever shaft 59E*a*; and, an operation pin 61E is provided on the leading end portion of the operation arm 60E in such a manner that the leading end thereof is engaged with a substantially U-shaped operation groove 58E which is so formed in the upper surface of the base portion of a cam body 50E as to extend in the axial direction of the cam body 50E. Further, on the leading end (in FIG. 20, the left end) of the change lever shaft 59E*a*, there is mounted a lever-shaped drive arm 62E serving as an operation part which can be operated from outside the sewing machine. And, a compression spring 105 is mounted on the change lever shaft 59E*a*, one end of the compression spring 105 is contacted with a retaining ring 107 which is mounted on the rear end of the change lever shaft 59E*a*, the other end of the compression spring 105 is contacted with the bottom surface 106*a* of a recessed groove 106 formed in the bottom surface of the moving mechanism mounting plate 104, and the retaining ring 107 is mounted on the neighborhood of the leading end of the change lever shaft 59E*a*, whereby not only the the change lever 62E can be moved in the axial direction of the change lever shaft 59E*a* thereof but also the change lever 62E is normally energized with a proper energizing force toward the upper surface of the moving mechanism mounting plate 104. Also, on the surface of the change lever 62E which is located adjacently to the root portion of the change lever 62E and is opposed to the moving mechanism mounting plate 104, there is provided a positioning pin 108 in such a manner that the leading end thereof projects toward the front surface of the moving mechanism mounting plate 104. On the front surface of the moving mechanism mounting plate 104, as shown in FIG. 21, there are formed a pair of drill holes 109*a* and 109*b* in such a manner that they are spaced from each other by a distance equal to the moving distance of the cam body 50E when changing the needle swing pattern, while the leading end portion of the positioning pin 108 can be fitted into the pair of drill holes 109*a* and 109*b*.

The above-mentioned operation groove 58E and change lever 62E cooperate together in forming the moving mechanism 63E according to the present embodiment.

Also, the above-mentioned positioning pin 108 and the pair of drill holes 109*a* and 109*b* cooperate together in forming a cam body positioning means 49E according to the present embodiment which restricts the moving position of the cam body 50E in the axial direction of the base portion thereof, while the cam body 50E according to the present embodiment is disposed outside the sewing machine.

According to the present embodiment, if the positioning pin 108 is fitted into one of the pair of drill holes 109*a* and 109*b*, then one position of the cam body 50E moving on the needle swing drive shaft 20 can be positioned. And, to change the needle swing pattern, the change lever 62E is pulled from outside the sewing machine in a direction where the change lever 62E is separated apart from the sewing machine main body 1E. As a result of this, the change lever 62E is moved together with the change lever 59E against the energizing force of the compression spring 105 in the direction where the change lever 62E is separated apart from the sewing machine main body 1E and, in linking with the movement of the change lever 62E, the positioning pin 108 is also moved in the direction where the positioning pin 108 is separated apart from the sewing machine main body 1E, so that the leading end of the positioning pin 108 fitted with one drill hole 109*b* shown in FIG. 21 is removed from the drill hole 109. In this state, if the change lever 62E is rotated clockwise in FIG. 21, then the cam body 50E is moved on the needle swing drive shaft 20. Next, after the change lever 62E is rotated clockwise in FIG. 21 to thereby oppose the leading end portion of the positioning pin 108 to the other drill hole 109*a*, if a force to pull the change lever 62E in the direction where the change lever 62E is separated apart from the sewing machine main body 1E is weakened, then the leading end portion of the positioning pin 108 is inserted into and fitted with the other drill hole 109*a* to thereby fix the position of the cam body 50E, so that the other position of the cam body 50E can be positioned.

With use of the present structure, if an operator operates the drive arm 62E serving as the operation part of the moving mechanism 63E from the FS side which is located outside the sewing machine, then the cam body 50E can be moved easily in the axial direction of the needle swing drive shaft 20, with the result that not only the efficiency of the operation to be executed by the operator when changing the needle swing pattern can be enhanced further but also the labor of the operator can be reduced further. Further, because the drive arm 62E serving as the operation part of the moving mechanism 63E is disposed in the stud portion of the sewing machine main body 1E, that is, because the drive arm 62E serving as the operation part of the moving mechanism 63E is situated at hand or near to the operation position of the operator, not only the efficiency of the operation to be executed by the operator when changing the needle swing pattern can be enhanced still further but also the labor of the operator can be reduced still further. Also, since the cam body positioning means 49E is disposed in the stud portion 101 of the sewing machine main body 1E, when the operator operates the cam body positioning means 49E to thereby change the needle swing pattern, the moving position of the cam body 50E can be set easily and positively. As a result of this, not only the efficiency of the operation to be executed by the operator when changing the needle swing pattern can be enhanced still further but also the labor of the operator can be reduced still further.

By the way, the above-mentioned moving mechanism 63E and cam body positioning means 49E according to the present embodiment can also be used in the previously described first, second and fourth embodiments.

Figure 22A:
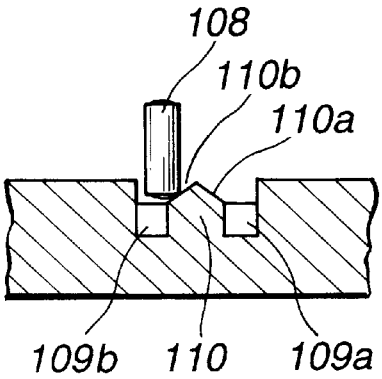
FIG. 22 (*a*) is an explanatory view of a state in which a positioning pin is slid on the inclined surface of a transition portion; and, FIG. 22 (*b*) is an explanatory view of a state in which a positioning pin is fitted into a drill hole.
Figure 22B:
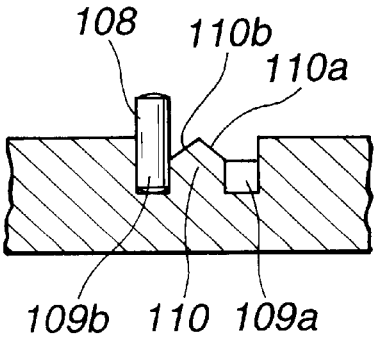

Also, as shown in FIGS. 22(*a*) and 22(*b*), there lies a transition portion 110 between the drill holes 109*a* and 109*b* into which the positioning pin 108 movable in linking with the movement of the change lever 62E when the change lever 59E is operated can be fitted; and, when the transition portion 110 is formed in a shape which comprises two inclined surfaces 110*a* and 110*b* with their respective one-side ends connected to their corresponding drill holes 109*a* and 109*b* and has a triangular section, if the positioning pin 108 is slid along the inclined surfaces 110*a* and 110*b* of the transition portion 110 as shown in FIG. 22(*a*), then the positioning pin 108 can be accurately guided to the drill holes 109*a* and 109*b*. Such formation of the transition portion 110 can prevent an accident that the sewing machine can be driven while the positioning pin 108 is not situated at a proper position and thus the position of the cam body 50E is not fixed, resulting in the breakage of a cam and the like.

Figure 23:
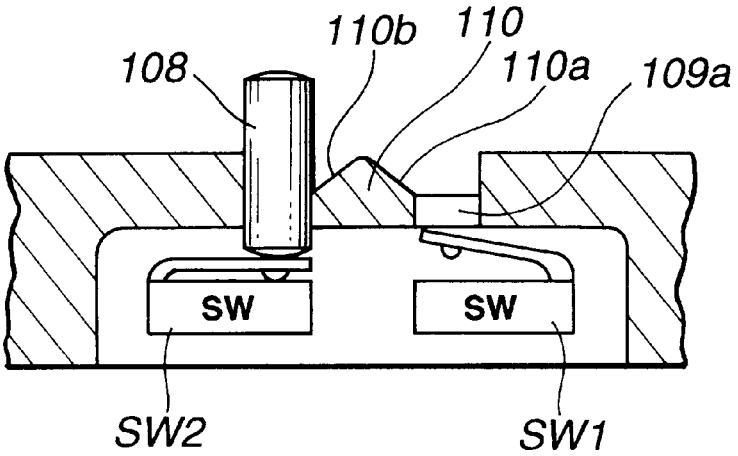
FIG. 23 is a section view of the main portions of a modification of the fifth embodiment.

Further, it is also possible to employ a structure that, as shown in FIG. 23, switches SW1 and SW2 for detecting the presence or absence of the positioning pin 108 are respectively disposed on the bottom portions of the drill holes 109*a* and 109*b*, and the presence or absence of the positioning pin 108 can be detected by these switches SW1 and SW2.

Figure 24:
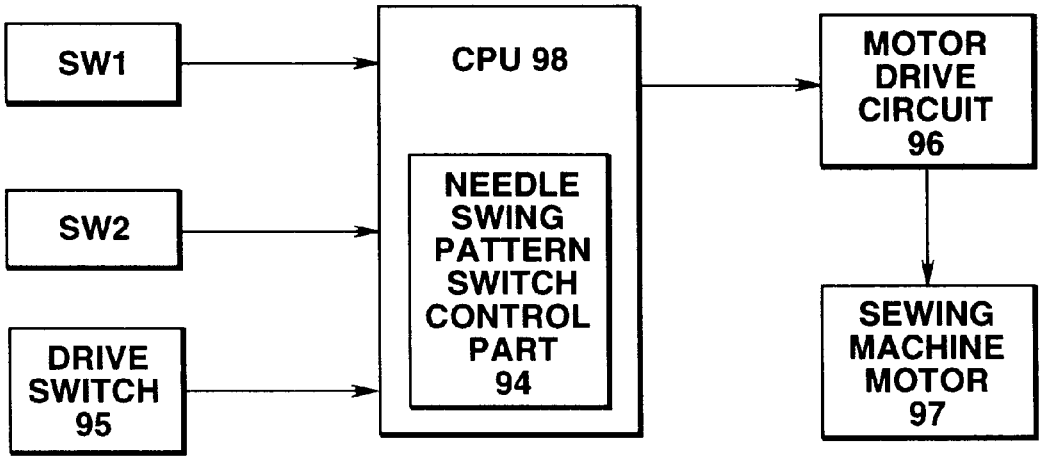
FIG. 24 is a block diagram of a drive transmission circuit in the modification shown in FIG. 23.

In this case, as shown in FIG. 24, there is completed a drive transmission circuit. That is, the switches SW1 and SW2 are respectively connected to a needle swing pattern switch control part 94 electrically. The needle swing pattern switch control part 94 is stored as a program in a CPU 98 which controls the drive state of a sewing machine motor 97 through a motor drive circuit 96 in accordance with ON—OFF signals to be transmitted from a sewing machine motor drive switch 95; and, the needle swing pattern switch control part 94 drives and controls the sewing machine motor 97 through the sewing machine motor drive circuit 96 on the needle swing pattern of one of the switches SW1 and SW2 that is detected on. This arrangement can prevent an accident such as the breakage of a cam and the like, thereby being able to secure more safety.

Figure 25:
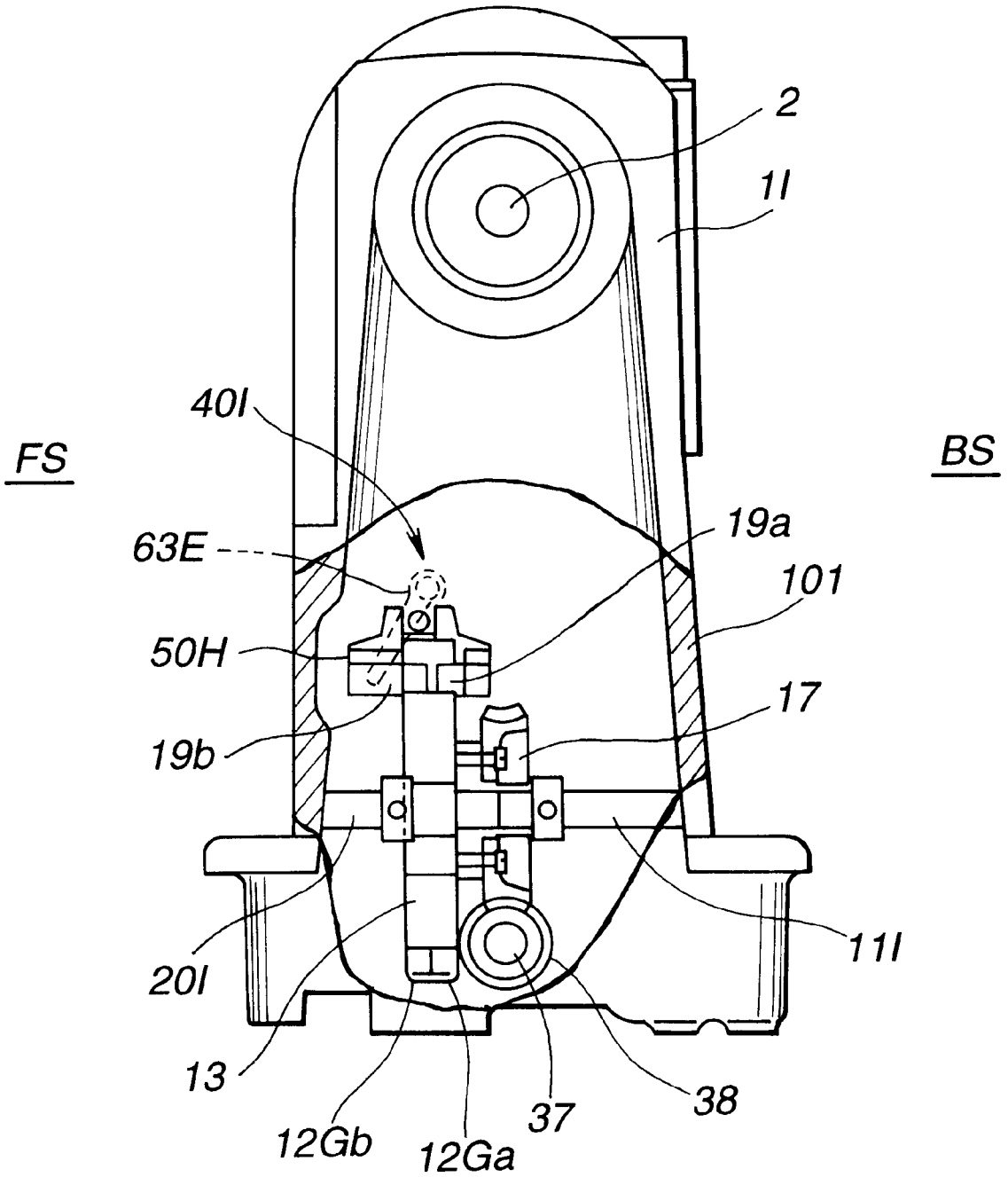
FIG. 25 is a front view of the main portions of a sixth embodiment of a sewing machine zigzag pattern changing device according to the invention.

Now, FIG. 25 shows the main portions of a sixth embodiment of a sewing machine zigzag pattern changing device according to the invention. In a sewing machine zigzag pattern changing device 401 according to the fifth embodiment, the needle swing cam 13 is disposed nearer to the FS side than a lower shaft 37 provided in the interior portion of a sewing machine main body 1. Also, a cam drive shaft 11 is supported on the BS side of the sewing machine main body 11, while a needle swing drive shaft 20J is supported on the FS side of the sewing machine main body 11. The remaining portions of the sixth embodiment are similar in structure to those employed in the previously described fourth embodiment.

Thanks to use of this structure, the present embodiment not only can provide a similar effect to the previously described fourth embodiment but also, because the needle swing cam 13 approaches the FS side where an operator executes his or her required operation, allows the operator to execute the required operation from the FS side when changing the needle swing pattern, with the result that the efficiency of the operation to change the needle swing pattern can be improved. Further, since the provision position of the zigzag pattern changing device 401 of the sewing machine main body 11 does not project out to the BS side (FIG. 30) as in the conventional switching devices, not only the sewing machine main body 11 can be made compact but also, when supplying the oil, the upper portion of sewing machine main body 11 can easily inclined toward the BS side, thereby being able to improve the efficiency of an operation to be executed for maintenance.

Also, as shown in FIG. 25, because the needle swing cam 13 can be located substantially below the upper shaft 2, the lubrication oil scattered from the upper shaft 2 into the interior portion of the sewing machine main body 11 can be supplied directly to the zigzag pattern changing device 401 more smoothly and more positively than the conventional sewing machine zigzag pattern changing device. As a result of this, the durability of the sewing machine zigzag pattern changing device 401 can be improved easily and the operation sound thereof can be reduced easily; and, at the same time, the enhancement of the operation efficiency of the sewing machine zigzag pattern changing device 401 as well as the reduction of the noise and vibrations thereof can be realized with ease.

By the way, as the moving mechanism 63E that is disposed in the sewing machine zigzag pattern changing device 401 according to the invention, it may have a similar structure to the previously described first embodiment, or may have a structure in which, similarly to the previously described third embodiment, the needle swing pattern can be changed automatically.

Figure 26:
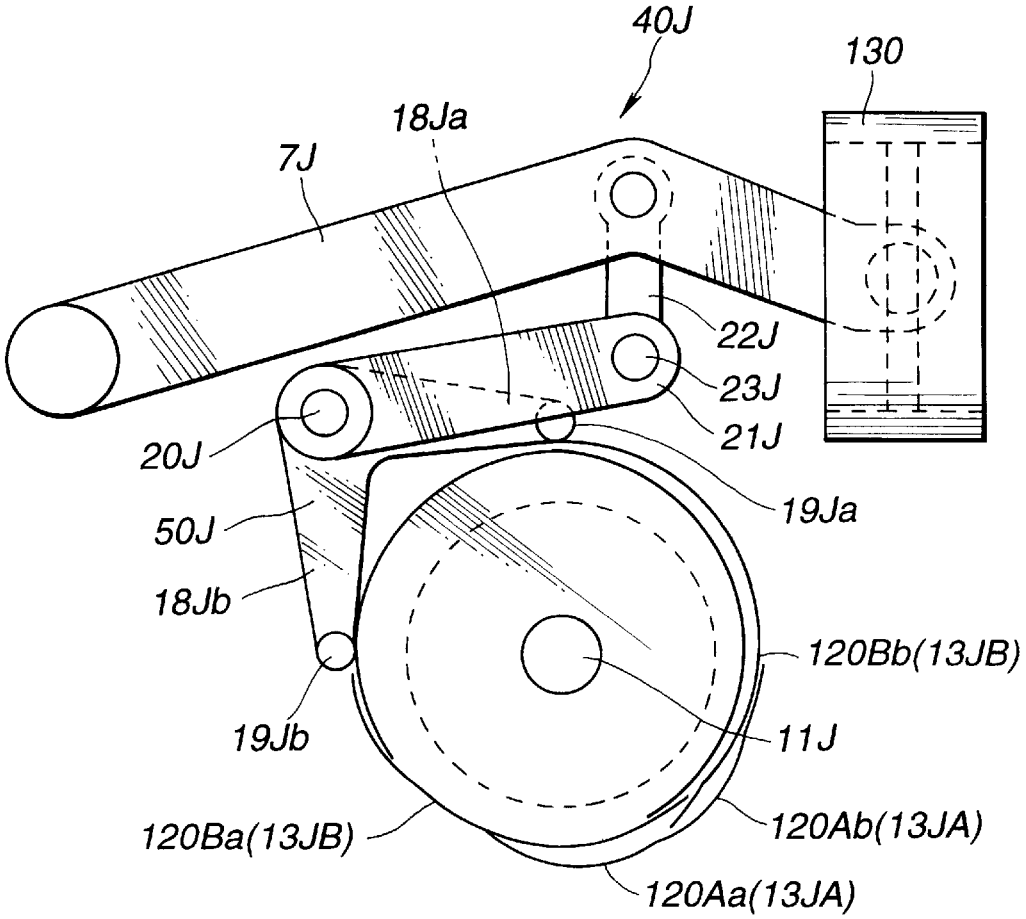
FIG. 26 is a partially omitted front view of the main portions of a seventh embodiment of a sewing machine zigzag pattern changing device according to the invention.
Figure 28:
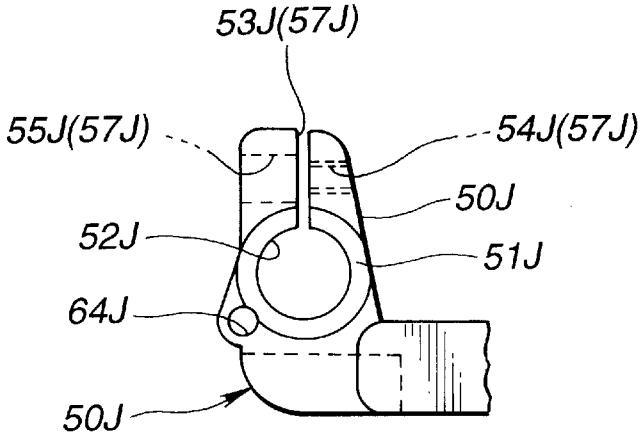
FIG. 28 is a partially enlarged front view of FIG. 26, showing the neighboring portion of the base portion of a cam body in an enlarged manner.
Figure 27:
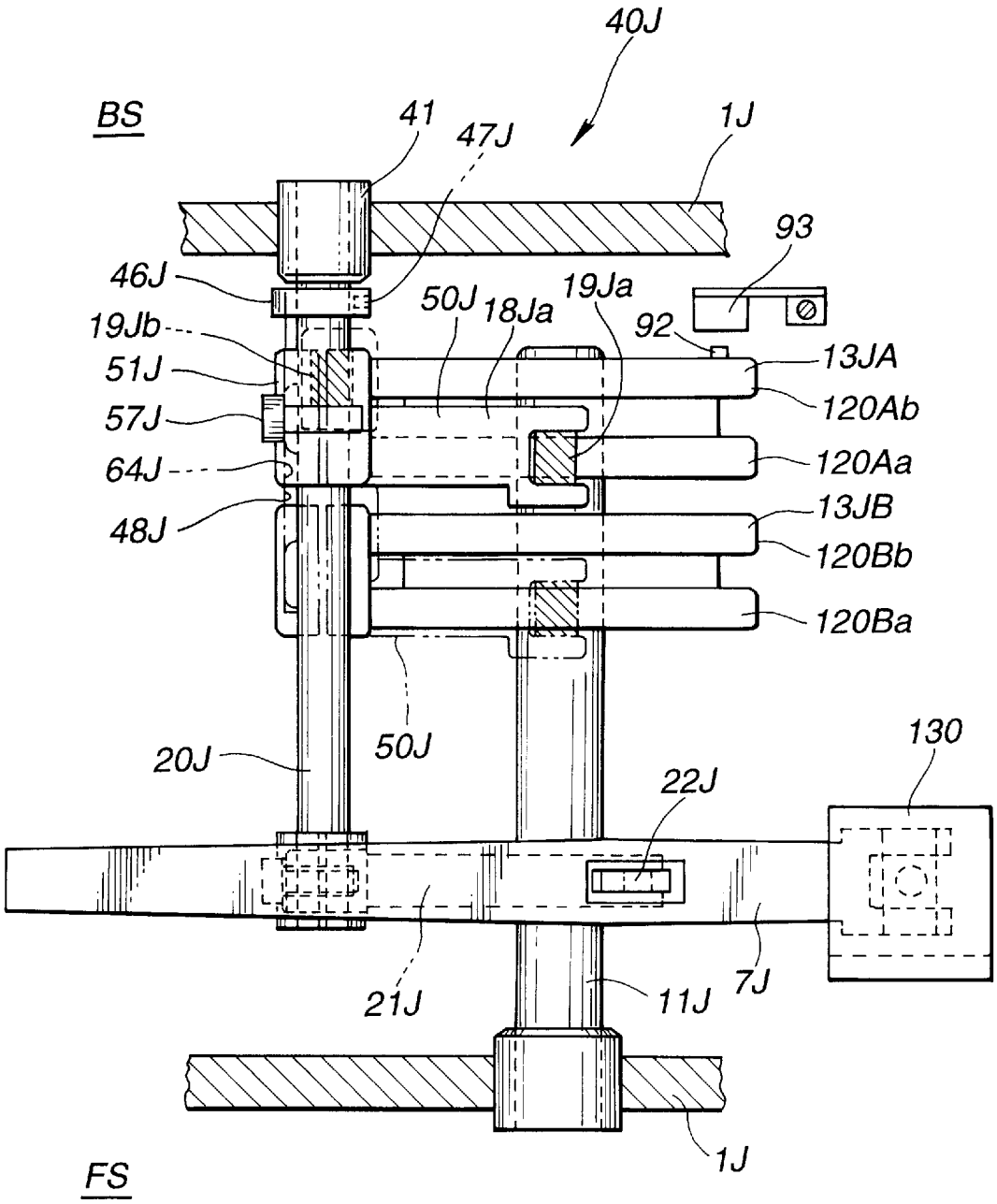
FIG. 27 is a plan view of FIG. 26.
Figure 29:
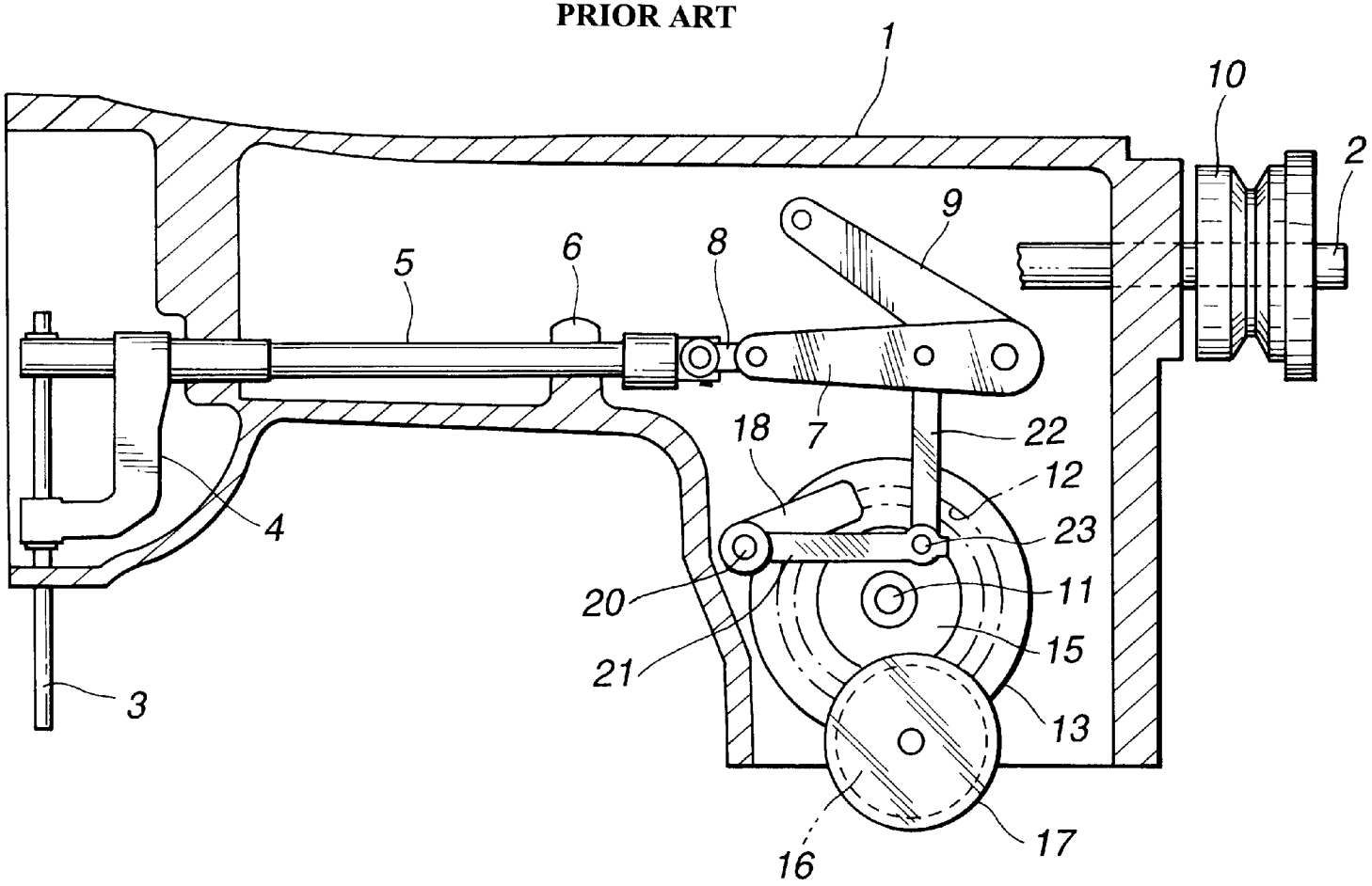
FIG.29 PRIOR ART
FIG. 29 is a front section view of a conventional sewing machine needle swing device.

Now, FIGS. 26 to 28 respectively show the main portions of a seventh embodiment of a sewing machine zigzag pattern changing device according to the invention. In particular, in the sewing machine zigzag pattern changing device 40J according to the present embodiment, instead of the needle swing cam 13 including the different cam grooves 12*a* and 12*b* respectively formed on the two surfaces thereof according to the previously described first embodiment, there are used two needle swing cams 13JA and 13JB respectively comprising conjugate cams which respectively include a pair of cam surfaces 120A*a*, 120A*b* and a pair of cam surfaces 120B*a*, 120B*b* formed on their outer peripheral surfaces; and, a guide shaft 48J is provided in a needle swing drive shaft 20J, and a guide hole 64J is formed in the base portion 51J of a cam body 50J. Also, a cam drive shaft 11J is supported on the FS side of a sewing machine main body 1J, while the needle swing drive shaft 20J is supported on the BS side of the sewing machine main body 1J.

Referring further to the sewing machine zigzag pattern changing device 40J according to the present embodiment, on the outer peripheral surface of one needle swing cam 13JA shown in the upper portion of FIG. 27, for example, there are formed a pair of cam surfaces 120A*a*, 120A*b* which are used to form the above-mentioned two-point zigzag; and, on the outer peripheral surface of the other needle swing cam 13JB shown in the lower portion of FIG. 27, for example, there are formed a pair of cam surfaces 120B*a*, 120B*b* which are used to form the above-mentioned four-point zigzag. And, in the base portion 51J of a cam body 50J, as shown in FIG. 28, there is formed a mounting hole 52J which can be loosely fitted with the outer peripheral surface of the needle swing drive shaft 20J. Also, in the upper portion of the base portion 51J of the cam body 50J, there is formed a slit 53J referred to as a slot which has a given width and extends in the axial direction of the cam body 50J; and, the slit 53J also extends in parallel to the axial direction of the mounting hole 52J in such a manner that a lower end thereof is connected to the mounting hole 52J and an upper end thereof is connected to the outer front surface of the upper portion of the base portion 51J of the cam body 50J. Further, as shown in the upper and lower portions of FIG. 27, while the slit 53J of the base portion 51J of the cam body 50J is situated almost at the central position of the length of the cam body 50J in the moving direction thereof, on the right of the slit 53J, there is formed a female screw 54J and, on the left of the slit 53J, there is formed a bolt hole 55J in such a manner that it is coaxial with the female screw 54J. And, as shown in FIG. 27, after the mounting hole 52J formed in the base portion 51J of the cam body 50J is loosely fitted with the outer peripheral surface of the neighborhood of the rear end portion of the needle swing drive shaft 20J, by bringing a given clamp screw 56J into threaded engagement with the female screw 54J from the bolt hole 55J side, the clearance of the slit 53J is narrowed to thereby reduce the diameter of the mounting hole 52J, with the result that the cam body 50J can be fixed to the needle swing drive shaft 20J at a given position thereof. Also, by loosening the clamp screw 56J in threaded engagement with the female screw 54J, the clearance of the slit 53J is enlarged to increase the diameter of the mounting hole 52J, thereby bringing the mounting hole 52J into loose fit with the outer peripheral surface of the needle swing drive shaft 20, with the result that the cam body 50J can be easily moved in the axial direction of the needle swing drive shaft 20 along the outer peripheral surface of the needle swing drive shaft 20 at least between solid and broken lines respectively shown in FIG. 27. Therefore, the cam body 50J is structured such that it is able to clamp or embrace the needle swing drive shaft 20J.

The above-mentioned slit 53J, female screw 54J, bolt hole 55J and clamp screw 56J cooperate together in forming the fixing means 57J capable of fixing the cam body 50J to the needle swing drive shaft 20 according to the present embodiment.

As shown in FIG. 28, diagonally and downwardly to the left of the mounting hole 52J of the base portion 51J of the cam body 50J, there is formed a guide hole 64J, while the guide shaft 48J shown in FIG. 27 is fitted into the guide hole 64J in such a manner that it can be moved in the axial direction thereof. And, the guide shaft 48J, as shown in FIG. 27, is fixed to a guide plate 46J which is fixed the needle swing drive shaft 20J at a given position thereof by a setscrew 47J or the like.

As shown in FIG. 26, in the cam body 50J, there are provided a pair of cam arms 18J*a* and 18J*b* which are formed integrally with the cam body 50J and are projected therefrom toward the needle swing cams 13JA and 13JB and, in the respective leading end portions of the cam arms 18J*a* and 18J*b*, there are rotatably disposed cam rollers 19J*a* and 19J*b* with which the cam surfaces 120A*a* and 120A*b* of the needle swing cam 13JA or the cam surfaces 120B*a* and 120B*b* of the needle swing cam 13JB can be contacted.

And, as shown in FIGS. 26 and 27, the base end portion of a needle swing drive arm 21J is fixed to the end portion of the BS side of the needle swing drive shaft 20J according to the present embodiment, while the base end portion of a drive rod 22J is rotatably connected to the leading end portion of the needle swing drive shaft 21J through a drive pin 23J. Also, the leading end portion of the drive rod 22J is connected to the middle portion of a needle swing drive link 7J in the longitudinal direction thereof and, on the right end of the needle swing drive link 7J, there is disposed a needle swing adjust body 130 which is used to control a needle swing width, that is, a needle drop position in a direction crossing at right angles to the cloth feeding direction.

Also, as shown in FIG. 27, on the surface of the needle swing cam 13JA that is located on the BS side thereof and is opposed to the sewing machine main body 1J, there is disposed a switch position marker 92 which is used when moving the cam body 50J automatically; and, at a position which is opposed to the switch position marker 92, there is disposed an optical sensor 93 serving as detect means which is used to detect the switch position marker 92. The remaining portions of the present or seventh embodiment are substantially similar in structure to the previously described first embodiment.

According to the above-mentioned structure, the guide shaft 48J and guide hole 64J according to the present embodiment can provide a similar effect to the previously described first embodiment.

That is, referring to the cam body 50J which moves on the needle swing drive shaft 20J, the guide hole 64J formed in the cam body 50J is guided along the guide shaft 48J provided in the needle swing drive shaft 20J and is thereby moved in the axial direction of the needle swing drive shaft 20J. Due to this, unlike the conventional sewing machine zigzag pattern changing device, the cam body 50J can be moved in the axial direction of the needle swing drive shaft 20J smoothly. Also, the cam body 50J moves on the needle swing drive shaft 20J in such a manner that it is supported at two points or contact portions thereof; namely, one is a contact portion thereof between the mounting hole 52J of the cam body 50J and the outer peripheral surface of the needle swing drive shaft 20J which are loosely fitted with each other, while the other is a contact portion thereof between the guide hole 64J and guide shaft 48J which are fitted with each other. This makes it possible to keep the assembling phase of the needle swing drive shaft 20J and cam body 50J almost unchanged, thereby being able to prevent the respective cam rollers 19J*a* and 19J*b* provided in the cam body 50J from varying in position.

Accordingly, since the guide shaft 48J and guide hole 64J can be worked easily with high precision due to fit between the shaft and hole, the play of the needle swing drive shaft 20J in the rotational direction thereof, which is produced between the cam body 50J and needle swing drive shaft 20J, and thus the right and left play of the needle bar can be reduced easily to a negligible level, thereby being able to prevent the cam body 50J from rotating about the needle swing drive shaft 20J. At the same time, because the assembling phase of the needle swing drive shaft 20J and cam body 50J when the cam body 50J mounted on the needle swing drive shaft 20J is moved along the needle swing drive shaft 20J in the axial direction thereof can be kept almost unchanged, unlike the conventional sewing machine zigzag pattern changing device, the respective cam rollers 19J*a* and 19J*b* are kept from varying in position, thereby being able to improve the efficiency of the operation to change the needle swing pattern.

By the way, as a moving mechanism (not shown) to be disposed in the sewing machine zigzag pattern changing device 40J according to the present embodiment, by selecting a proper one out of the moving mechanisms employed in the previously described embodiments of the invention according to the need thereof such as the design concept and the like, the efficiency of the operation to change the needle swing pattern can be enhanced. Also, if there is employed a structure which, similarly to the previously described third embodiment, is able to change the needle swing pattern automatically, then not only the efficiency of the operation to change the needle swing pattern can be enhanced further but also the labor of the operator can be reduced further. Further, if there is employed a structure which includes switch position display means similar to the switch position display means 43 employed in the previously described first embodiment, then the efficiency of the operation to change the needle swing pattern can be enhanced. And, there can also be employed a structure in which the two needle swing cams 13JA and 13JB are formed integrally with each other. Further, it is also possible to employ a structure in which, similarly to the previously described sixth embodiment, the two needle swing cams 13JA and 13JB are disposed nearer to the FS side than the lower shaft 37 located in the interior portion of the sewing machine main body 1J. And, the guide shaft 48J and guide hole 64J may be formed respectively in at least one of the needle swing drive shaft 20J and cam body 50J. Also, according to the present embodiment, there is employed the structure in which the two needle swing cams 13JA and 13JB are disposed to thereby be able to form two kinds of needle swing patterns. However, this is not limitative, but it is also possible to employ a structure in which three or more needle swing cams 13JA and 13JB,—are disposed to thereby be able to form three or more kinds of needle swing patterns. And, if the switch point SP serving as a switchable phase when changing the needle swing pattern of the needle swing cam 13J is set such that it is situated at a needle drop position at least one end in the needle swing width direction, that is, a needle drop position in the left- or right-most end of the needle, then the operator can easily find the left- or right-most end needle drop position in the needle swing width direction of the needle when changing the needle swing pattern, so that the switch point SP of the needle swing cam 13J can be positioned easily by an operator's simple operation. As a result of this, not only the labor of the operator necessary to change the needle swing pattern can be reduced easily but also the efficiency of the operation to change the needle swing pattern can be enhanced easily. In this case, it is not always necessary to provide the above-mentioned switch position display means 43.

By the way, although illustration and description are omitted here, the above-mentioned respective embodiments can also be used in various combinations thereof. For instance, according to the first and fourth embodiments, the guide shaft and the guide hole are provided with either the cam body, the needle swing driving shaft, or the needle swing arm. However, it may be modified to arrange opposite to these embodiments.

As has been described heretofore, with use of a sewing machine zigzag pattern changing device according to the invention, the guide member and the member to be guided, with which the guide shaft of the guide member can be so fitted as to be movable in the axial direction thereof, are able to move the cam body smoothly in the axial direction thereof and are also able to prevent the cam body from rotating about the needle swing drive shaft.

With use of a sewing machine zigzag pattern changing device according to the invention, the guide shaft and the guide hole, with which the guide shaft can be so fitted as to be movable in the axial direction thereof, are able to move the cam body smoothly in the axial direction thereof. Also, the guide shaft and guide hole are able to prevent the cam body from rotating about the needle swing drive shaft and, at the same time, due to fit between the shaft and hole, they can be worked easily with high precision, thereby being able to reduce the play of the needle swing drive shaft in the rotational direction thereof that is produced between the cam body and needle swing drive shaft, so that the sewing quality of the sewn products can be improved. Further, the guide shaft and the guide hole, with which the guide shaft can be so fitted as to be movable in the axial direction thereof, are able to keep the assembling phase of the needle swing drive shaft and cam body almost unchanged when the cam body mounted on the needle swing drive shaft is moved along the needle swing drive shaft in the axial direction thereof.

And, with use of a sewing machine zigzag pattern changing device according to the invention, since the flat surface of the stopper disposed in the cam body is slid along the plane portion of the needle swing drive shaft that is formed in at least part of the outer peripheral surface of the needle swing drive shaft and extends in parallel to the axial direction thereof, the cam body can be moved smoothly in the axial direction of the needle swing drive shaft. Also, by bringing the flat surface of the stopper into slidable contact with the plane portion of the needle swing drive shaft, the cam body can be prevented from rotating about the needle swing drive shaft and high-precision working can be executed easily, thereby being able to reduce easily the play of the needle swing drive shaft in the rotational direction thereof that is produced between the cam body and needle swing drive shaft, so that the sewing quality of the sewn products can be enhanced. Further, the plane portion of the needle swing drive shaft and the flat surface of the stopper that can be slidably contacted with the present plane portion are able to keep the assembling phase of the needle swing drive shaft and cam body almost unchanged when the cam body mounted on the needle swing drive shaft is moved along the needle swing drive shaft in the axial direction thereof.

And, with use of a sewing machine zigzag pattern changing device according to the invention, the guide shaft and the guide hole, with which the guide shaft can be so fitted as to be movable in the axial direction thereof, are able to move the cam body smoothly in the axial direction thereof. Also, the guide shaft and guide hole are able to prevent the cam body from rotating about the needle swing drive shaft and, at the same time, due to fit between the shaft and hole, they can be worked easily with high precision, thereby being able to reduce the play of the needle swing drive shaft in the rotational direction thereof (and thus the play of the needle bar) that is produced between the cam body and needle swing drive shaft, so that the sewing quality of the sewn products can be improved. Further, the guide shaft and the guide hole, with which the guide shaft can be so fitted as to be movable in the axial direction thereof, are able to keep the assembling phase of the needle swing drive shaft and cam body almost unchanged when the cam body mounted on the needle swing drive shaft is moved along the needle swing drive shaft in the axial direction thereof.

Also, with use of a sewing machine zigzag pattern changing device according to the invention, when the movement of the cam body is not sufficient due to a wrong operation by an operator or the like, there can be set a non-engagement state in which the pair of cam rollers are prevented against engagement with neither of the pair of cam grooves. As a result of this, it is possible to prevent easily the sewing machine zigzag pattern changing device from being broken when the movement of the cam body is not sufficient due to the wrong operation by the operator or the like.

And, with use of a sewing machine zigzag pattern changing device according to the invention, the provision of the support member not only makes it possible to move the cam body smoothly in the axial direction of the needle swing drive shaft, but also can prevent the cam body from rotating about the needle swing drive shaft.

Also, with use of a sewing machine zigzag pattern changing device according to the invention, it is possible to prevent easily the sewing machine zigzag pattern changing device from being broken when the movement of the cam body is not sufficient due to the wrong operation by the operator or the like.

With use of a sewing machine zigzag pattern changing device according to the invention, since the switch position of the needle swing cam when changing the needle swing pattern can be displayed easily, the operator is able to confirm the switch position of the needle swing cam with ease, with the result that the efficiency of the operation to be executed when changing the needle swing pattern can be enhanced.

With use of a sewing machine zigzag pattern changing device according to the invention, since the switch position of the needle swing cam when changing the needle swing pattern can be displayed more easily and accurately, the operator is able to confirm the switch position of the needle swing cam with more ease and accuracy, with the result that the efficiency of the operation to be executed when changing the needle swing pattern can be enhanced further.

With use of a sewing machine zigzag pattern changing device according to the invention, the switch position of the needle swing cam when changing the needle swing pattern can be displayed still more easily and accurately.

And, with use of a sewing machine zigzag pattern changing device according to the invention, the operation part allows the cam body and guide arm to be moved more easily in the axial direction thereof from outside the sewing machine, which makes it possible to not only improve the efficiency of the operation to be executed by the operator when changing the needle swing pattern but also reduce the labor of the operator necessary to execute the needle swing pattern changing operation.

Also, with use of a sewing machine zigzag pattern changing device according to the invention, since the operation part is situated in the stud portion of the sewing machine, the operation part can be operated simply by hand during the sewing operation, which makes it possible to not only improve further the efficiency of the operation to be executed by the operator when changing the needle swing pattern but also reduce further the labor of the operator necessary to execute the needle swing pattern changing operation. Also, the operation part does not interfere with the sewing operation.

Further, with use of a sewing machine zigzag pattern changing device according to the invention, the sewing machine is prevented from being driven in a state where the positioning pin is set at a half position and thus the cam body is not fixed, thereby being able to prevent the cam against breakage or the like.

Still further, with use of a sewing machine zigzag pattern changing device according to the invention, since the sewing machine motor is driven and controlled through the sewing machine drive circuit in correspondence to one of the needle swing patterns associated with the switch SW that is detected on, it is possible to prevent an accident such as the breakage of the cam, thereby being able to secure further safety.

In addition, with use of a sewing machine zigzag pattern changing device according to the invention, since the oil drops are forcibly dropped down to the contact body from above by the oil drop supply means, the interior portion of the cam groove can also be lubricated through the contact body and thus the oil can be held within the cam groove as well. This makes it possible to prevent wear between the contact body and cam groove which could be otherwise caused due to their mutual sliding motion.

What is claimed is:

1. A zigzag pattern changing device for use in a sewing machine, said device comprising:

a sewing machine frame;

a sewing machine main shaft;

a cam drive shaft (11) supported in said sewing machine frame in such a manner that it can be rotated decelerratingly in linking with said sewing machine main shaft;

a needle swing cam (13) supported on said cam drive shaft and including at least two cams which are spaced apart from each other in the axial direction of said needle swing cam and respectively correspond to different needle swing patterns;

a needle swing drive shaft (20) disposed in parallel to said cam drive shaft, supported in said sewing machine frame wherein the needle swing drive shaft makes swing motions about the axis thereof, and connected to a needle mechanism so that the needle swing drive shaft moves a needle in a direction at right angles to a cloth feeding direction due to said swing motion;

a cam body (50) including a pair of contact bodies separately engageable with and removable from said two cams, for transmitting swing motions of said contact body due to one of said needle swing cams to be engaged to said needle swing drive shaft, and supported on said needle swing drive shaft in such a manner that said cam body is movable in the axial direction of said needle swing drive shaft;

switching means (59) connected to said cam body for moving said cam body in the axial direction of said needle swing drive shaft to one position where one contact member is engagable with one cam groove and to another position where the other contact member is engagable with the other cam groove;

a guiding member disposed in parallel to the axial direction of said needle swing drive shaft; and, a guided member to be guided engageable with said guiding member and relatively movable in the axial direction of said needle swing drive shaft.

2. The zigzag pattern changing device according to claim 1, wherein said guiding member and said guided member respectively comprise a guide shaft, which is supported on one of said needle swing drive shaft and said cam body, and a guide hole which is formed in the other of said needle swing drive shaft and said cam body and into which said guide shaft can be slidably fitted.

3. The zigzag pattern changing device according to claim 1, wherein said guiding member comprises a plane portion which is formed in the outer periphery of said needle swing drive shaft and extends in the axial direction of said needle swing drive shaft, and said guided member comprises a stopper including a flat surface portion which can be slidably contacted with said plane portion.

4. The zigzag pattern changing device according to claim 1, further comprising:

a needle swing drive arm supported on said needle swing drive shaft for transmitting the swing motion of said needle swing drive shaft to a needle mechanism, wherein said guiding member and said guided member respectively comprises a guide shaft supported on one of said needle swing drive shaft and said cam body, and a guide hole which is formed in the other of said needle swing drive shaft and said cam body and into which said guide shaft can be slidably fitted.

5. A zigzag pattern changing device for use in a sewing machine, said device comprising:

a sewing machine frame;

a sewing machine main shaft;

a cam drive shaft (11) supported in said sewing machine frame in such a manner that it can be rotated decelerratingly in linking with said sewing machine main shaft;

a needle swing cam (13) supported on said cam drive shaft and including at least two cams which are spaced apart from each other in the axial direction of said needle swing cam and respectively correspond to different needle swing patterns;

a needle swing drive shaft (20) disposed in parallel to said cam drive shaft, supported in said sewing machine frame wherein the needle swing drive shaft makes swing motions about the axis thereof, and connected to a needle mechanism so that the needle swing drive shaft moves a needle in a direction at right angles to a cloth feeding direction due to said swing motion;

a cam body (50) including a pair of contact bodies separately engageable with and removable from said two cams, for transmitting swing motions of said contact body due to one of said needle swing cams to be engaged to said needle swing drive shaft, and supported on said needle swing drive shaft in such a manner that said cam body is movable in the axial direction of said needle swing drive shaft;

switching means (59) connected to said cam body for moving said cam body in the axial direction of said needle swing drive shaft to one position where one contact member is engagable with one cam groove and to the other position where the other contact member is engagable with the other cam groove; and, a support member extending along the direction of an axis in parallel to said needle swing drive shaft, spaced in a diameter direction from said axis, and supporting said cam body such that said cam body can be slid in the axial direction of said needle swing drive shaft, for preventing said cam body from rotating around the axis of said needle swing drive shaft.

6. The zigzag pattern changing device according to claim 1, wherein, at a position in the middle of the movement of said cam body to said two positions by said switching means, there can be set a non-engagement state in which both of said contact bodies are separated from their respective cam grooves.

7. The zigzag pattern changing device according to claim 1, wherein, a pair of marks are provided in correspondence to the rotation phase of said needle swing cam where said contact bodies are simultaneously removable from said cam grooves.

8. The zigzag pattern changing device according to claim 7, wherein said pair of marks are respectively formed in said needle swing cam and in said sewing machine frame.

9. The zigzag pattern changing device according to claim 7, wherein said pair of marks are respectively formed in a sewing machine drive shaft and in said sewing machine frame.

10. The zigzag pattern changing device according to claim 1, further comprising:

an operation part which makes it possible to operate said cam body from outside said sewing machine and thereby move the same in the axial direction of said needle swing drive shaft.

11. The zigzag pattern changing device according to claim 10, wherein said operation part is disposed in the stud portion of said sewing machine main body.

12. The zigzag pattern changing device according to claim 10, wherein said operation part includes a positioning pin movable in linking with the operation of a change lever and a pair of recessed portions fittable with said positioning pin, said positioning pin is normally energized in a direction to fit with said recessed portions, and a transition portion between said pair of recessed portions is formed in a shape which is a pair of inclined surfaces each having one end thereof connected to said corresponding recessed portion and also which has a triangular cross section.

13. The zigzag pattern changing device according to claim 12, further comprising:

switches disposed in the respective bottom portions of said pair of recessed portions, for detecting the presence or absence of said positioning pin.

14. The zigzag pattern changing device according to claim 1, further comprising:

oil drop supply means disposed upwardly of positions where said pair of cam grooves are formed, for dropping oil, which has previously been sucked up by an oil supply pump, down to said contact bodies fittable with said respective cam grooves.

15. The zigzag pattern changing device according to claim 5, wherein, at a position in the middle of the movement of said cam body to said two positions by said switching means, there can be set a non-engagement state in which both of said contact bodies are separated from their respective cam grooves.

16. The zigzag pattern changing device according to claim 5, wherein a pair of marks are provided in correspondence to the rotation phase of said needle swing cam where said contact bodies are simultaneously removable from said cam grooves.

17. The zigzag pattern changing device according to claim 5, further comprising:

an operation part which makes it possible to operate said cam body from outside said sewing machine and thereby move the same in the axial direction of said needle swing drive shaft.

18. The zigzag pattern changing device according to claim 5, further comprising:

oil drop supply means disposed upwardly of positions where said pair of cam grooves are formed, for dropping oil, which has previously been sucked up by an oil supply pump, down to said contact bodies fittable with said respective cam grooves.

* * * * *